US008443541B2

(12) United States Patent
Elpedes et al.

(10) Patent No.: US 8,443,541 B2
(45) Date of Patent: May 21, 2013

(54) OPTICAL SIGHT

(75) Inventors: Jerry Glen Sabaldan Elpedes, Milford, MI (US); Darin W. Schick, Livonia, MI (US); Mark William Lister, Berkley, MI (US); Joshua Lee Varner, Commerce, MI (US)

(73) Assignee: Trijicon, Inc., Wixom, MI (US)

( * ) Notice: Subject to any disclaimer, the term of this patent is extended or adjusted under 35 U.S.C. 154(b) by 0 days.

(21) Appl. No.: 13/418,671

(22) Filed: Mar. 13, 2012

(65) Prior Publication Data

US 2012/0167443 A1 Jul. 5, 2012

Related U.S. Application Data

(63) Continuation of application No. 12/570,377, filed on Sep. 30, 2009, now Pat. No. 8,215,050.

(60) Provisional application No. 61/102,222, filed on Oct. 2, 2008.

(51) Int. Cl.
*F41G 1/30* (2006.01)

(52) U.S. Cl.
USPC ..... 42/130; 42/113

(58) Field of Classification Search
USPC ..... 42/113, 122, 123, 130, 131
See application file for complete search history.

(56) References Cited

U.S. PATENT DOCUMENTS

| | | | |
|---|---|---|---|
| 2,633,051 | A | 3/1953 | Davis |
| 3,577,668 | A | 5/1971 | Ruger et al. |
| 3,834,035 | A | 9/1974 | Merrill |
| 3,963,356 | A | 6/1976 | Wiklund |
| 4,017,995 | A | 4/1977 | Hughes, Jr. |
| 4,665,622 | A | 5/1987 | Idan |
| 4,764,011 | A | 8/1988 | Goldstein |
| 5,189,555 | A | 2/1993 | Jorlov |
| 5,369,888 | A | 12/1994 | Kay et al. |
| 5,373,644 | A | 12/1994 | DePaoli |
| 5,383,278 | A | 1/1995 | Kay |
| 5,483,362 | A | 1/1996 | Tai et al. |
| 5,523,883 | A | 6/1996 | Myers et al. |
| 5,653,034 | A | 8/1997 | Bindon |
| 5,813,159 | A | 9/1998 | Kay et al. |

(Continued)

FOREIGN PATENT DOCUMENTS

JP 5172495 A 7/1993

OTHER PUBLICATIONS

International Search Report and Written Opinion of the International Searching Authority for International Application No. PCT/US2009/059185, mailed May 19, 2010.

(Continued)

*Primary Examiner* — Stephen M Johnson
(74) *Attorney, Agent, or Firm* — Harness, Dickey & Pierce, P.L.C.

(57) ABSTRACT

An optical sight is provided and may include a housing having a base, a first post extending from the base, and a second post extending from the base. The optical sight may additionally include an optical element supported by the housing between the first post and the second post, a reticle displayed on the optical element, and an illumination system generating the reticle. A first actuation member may be disposed on one of the first post and the second post and may selectively control an intensity of the reticle by controlling an output of the illumination system.

20 Claims, 11 Drawing Sheets

U.S. PATENT DOCUMENTS

| | | | | |
|---|---|---|---|---|
| 5,815,936 | A | 10/1998 | Sieczka et al. | |
| 6,327,806 | B1 | 12/2001 | Paige | |
| 6,516,551 | B2 | 2/2003 | Gaber | |
| 6,807,742 | B2 | 10/2004 | Schick et al. | |
| 7,069,685 | B2 | 7/2006 | Houde-Walter | |
| 7,171,776 | B2 | 2/2007 | Staley, III | |
| 7,225,578 | B2 | 6/2007 | Tai | |
| 7,234,265 | B1 | 6/2007 | Cheng et al. | |
| 7,269,920 | B2 | 9/2007 | Staley, III | |
| 7,454,860 | B2 | 11/2008 | Houde-Walter | |
| 7,634,866 | B2 | 12/2009 | Javorsky | |
| 7,721,481 | B2 | 5/2010 | Houde-Walter | |
| 2002/0078618 | A1 | 6/2002 | Gaber | |
| 2004/0047586 | A1 | 3/2004 | Schick et al. | |
| 2004/0148841 | A1 | 8/2004 | Burzel | |
| 2005/0198885 | A1 | 9/2005 | Staley | |
| 2005/0241207 | A1 | 11/2005 | Staley | |
| 2005/0241209 | A1 | 11/2005 | Staley | |
| 2006/0010761 | A1 | 1/2006 | Staley | |
| 2006/0048432 | A1 | 3/2006 | Staley | |
| 2006/0162226 | A1 | 7/2006 | Tai | |
| 2006/0225335 | A1* | 10/2006 | Florence et al. | 42/123 |
| 2006/0236585 | A1 | 10/2006 | Houde-Walter | |
| 2006/0248777 | A1* | 11/2006 | Florence et al. | 42/123 |
| 2008/0163749 | A1 | 7/2008 | Reimer | |
| 2008/0216379 | A1 | 9/2008 | Javorsky | |
| 2009/0051989 | A1 | 2/2009 | Dobschal et al. | |
| 2009/0172991 | A1 | 7/2009 | Ballard | |
| 2009/0193705 | A1 | 8/2009 | LoRocco | |
| 2010/0275495 | A1 | 11/2010 | Jung et al. | |

OTHER PUBLICATIONS

Non-Final Office Action for U.S. Appl. No. 12/646,166, mailed Aug. 1, 2011.

Non-Final Office Action for U.S. Appl. No. 13/108,043, mailed Jul. 5, 2011.

Non-Final Office Action for U.S. Appl. No. 12/570,377, mailed Dec. 9, 2011.

Non-Final Office Action for U.S. Appl. No. 13/099,491, mailed Jun. 23, 2011.

Non-Final Office Action for U.S. Appl. No. 13/108,043, mailed Oct. 12, 2011.

* cited by examiner

OPTICAL SIGHT

CROSS-REFERENCE TO RELATED APPLICATIONS

This application is a continuation of U.S. patent application Ser. No. 12/570,377, filed on Sep. 30, 2009, now U.S. Pat. No. 8,215,050, which claims the benefit of U.S. Provisional Application No. 61/102,222, filed on Oct. 2, 2008. The entire disclosures of the above applications are incorporated herein by reference.

FIELD

The present disclosure relates to sighting systems and more particularly to an optical sighting system.

BACKGROUND

This section provides background information related to the present disclosure which is not necessarily prior art.

Firearms conventionally incorporate a sight to aid in aligning a trajectory of the firearm with a target. In one configuration, the sight includes an upwardly extending arm fixed relative to a barrel of a firearm, whereby a user of the firearm may properly align an end of the barrel with a target by aligning the upwardly extending arm with the target.

In addition to use of a fixed, upwardly extending arm, conventional firearm sights may also incorporate an optical element that displays an illuminated reticle for use in aligning a barrel of a firearm with a target. One such prior-art sight is disclosed in U.S. Pat. No. 6,327,806. The foregoing sight incorporates an optical element, which receives light from a light emitting diode (LED) and displays a reticle on a lens for use by a user in aligning a barrel of a firearm with a target. Such a sight incorporating a lens and an illuminated reticle is generally an improvement over a firearm incorporating a fixed, upwardly extending arm, as the illuminated reticle of the optical sight may be viewed from numerous angles from a rear portion of the firearm and does not have to be exactly aligned with an eye of the user. Allowing the reticle to be viewed from numerous angles from an area generally behind the firearm allows the user to be positioned somewhat offset from a longitudinal axis of the firearm while still maintaining a barrel of the firearm trained on a target.

While the foregoing optical sight is an improvement over a fixed, upwardly extending arm disposed proximate to an end of a firearm, conventional optical sights typically include an optical lens having a generally convex upper surface, which is easily fractured if dropped. While conventional optical sights typically include a housing having a portion extending over the convex upper surface, the housing typically includes a similar convex shape and, as such, transmits a force applied at an outer surface thereof directly to an outer surface of the lens, thereby causing the lens to fracture. Once the lens of the optical sight is fractured, the sight may not be used and, therefore, reduces the overall effectiveness of the firearm.

In addition to the likelihood of fracture, conventional optical sights suffer from the disadvantage of including an LED, which requires a power source to illuminate a reticle. While such LEDs adequately illuminate a reticle, the power source supplying power to the LED is not infinite. Because the power source supplying power to the LED is not infinite, care must be taken to routinely check the life of the power source to ensure that the reticle is consistently displayed. While recharging or replacing the power source of a conventional sight is relatively simple, such tasks become difficult in a military or law enforcement operation where time is of the essence and reliability on equipment is key. Having a power source expire during a law enforcement or military operation reduces the overall effectiveness of the firearm on which the optical sight is mounted and, as a result, reduces the effectiveness of the law enforcement agent or soldier.

Based on the foregoing, an optical sight incorporating multiple light sources, such as, for example, an LED, a fiber optic, and a tritium lamp, that can accommodate various ambient-light conditions is desirable in the industry. Incorporating multiple light sources into an optical sight provides flexibility in illuminating a reticle, as each source or a combination of sources can be chosen based on the particular ambient-light conditions.

In one configuration, light from the fiber optic and tritium lamp may be combined to illuminate a reticle. In another configuration, light from the LED may additionally or alternatively be used should the supplied light from the fiber optic and/or tritium lamp be insufficient. Further yet, light from any one of the sources may be used independently of the other sources. In any of the foregoing configurations, providing an optical sight with multiple light sources allows the optical sight to be used in virtually any ambient-light condition and provides the user with a reliable and useful sight.

SUMMARY

This section provides a general summary of the disclosure, and is not a comprehensive disclosure of its full scope or all of its features.

An optical sight is provided and may include a housing having a base, a first post extending from the base, and a second post extending from the base. The optical sight may additionally include an optical element supported by the housing between the first post and the second post, a reticle displayed on the optical element, and an illumination system generating the reticle. A first actuation member may be disposed on one of the first post and the second post and may selectively control an intensity of the reticle by controlling an output of the illumination system.

In another configuration, an optical sight is provided and may include a housing having a base, a first post extending from the base, and a second post extending from the base. The optical sight may additionally include an optical element supported by the housing between the first post and the second post, a reticle displayed on the optical element, and an illumination system generating the reticle. A first actuation member may be disposed on one of the first post and the second post and may be movable between a first state and a second state. Likewise, a second actuation member may be disposed on the other of the first post and the second post and may be movable between a first state and a second state. The first actuation member and the second actuation member may selectively control an intensity of the reticle by controlling an output of the illumination system.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
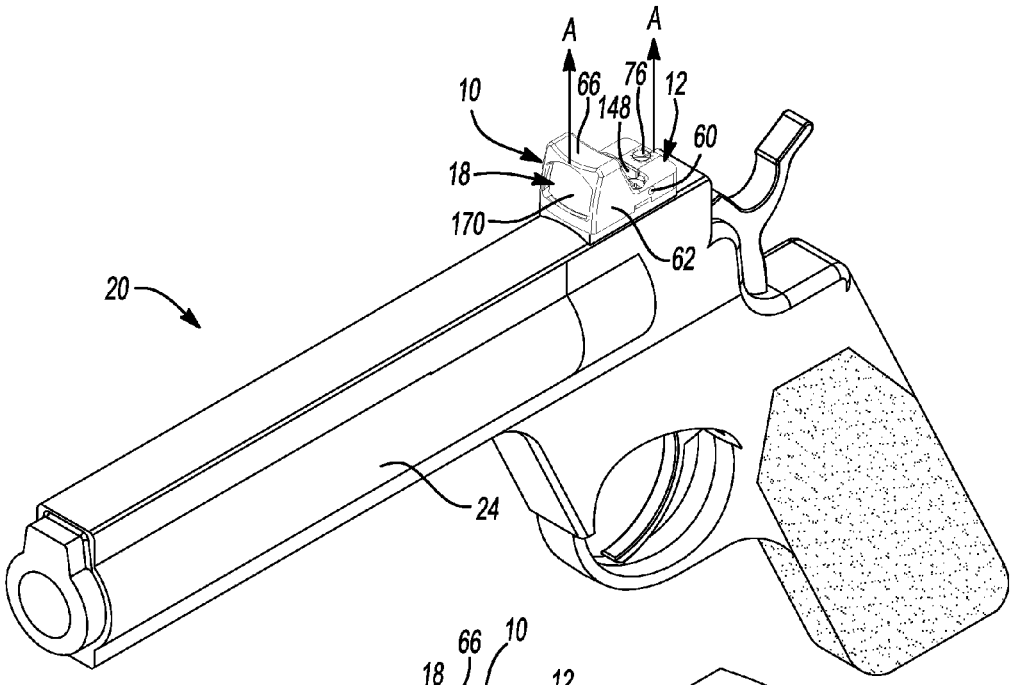
FIG. 1 is a perspective view of a firearm incorporating an optical sight in accordance with the principles of the present disclosure.
Figure 2:
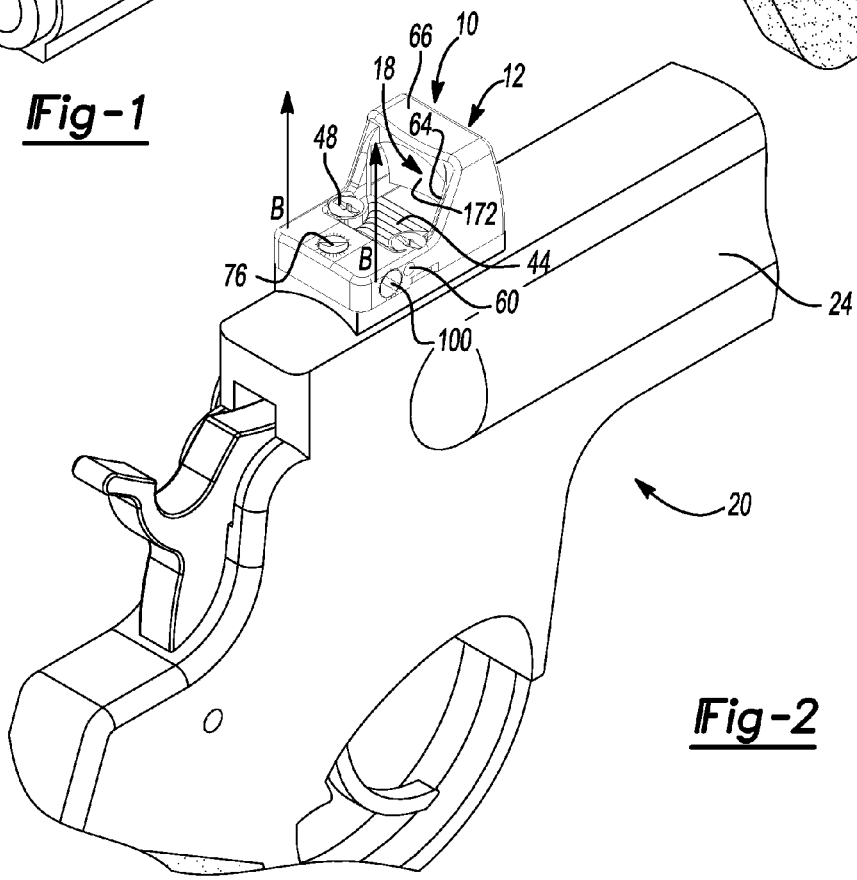
FIG. 2 is a perspective view of the firearm of FIG. 1 showing a rear portion of the optical sight.

Example embodiments will now be described more fully with reference to the accompanying drawings.

With reference to the figures, an optical sight 10 is provided and may include a housing 12, an adjustment assembly 14, an illumination assembly 16, and an optical element 18. Each of the adjustment assembly 14, illumination assembly 16, and optical element 18 may be supported by and attached to the housing 12 such that the housing 12 supports the adjustment assembly 14, illumination assembly 16 and optical element 18 relative to a firearm 20. When the housing 12 is mounted to the firearm 20, the illumination assembly 16 may cooperate with the optical element 18 to display a reticle 22 on the optical element 18 to facilitate alignment of a trajectory of the firearm 20 with a target (not shown). The adjustment assembly 14 may interact with the illumination assembly 16 to move the illumination assembly 16 relative to the housing 12 to adjust a position of the reticle 22 relative to the optical element 18. While the optical sight 10 may be used with various firearms, such as, for example, a bow or rocket launcher, the optical sight 10 will be described hereinafter and shown in the drawings as being associated with a barrel 24 of a firearm 20.

The housing 12 may include a main body 26 and an upwardly extending portion 28 extending generally from the main body 26 and including a longitudinal axis substantially ninety degrees to a longitudinal axis of the main body 26. The main body 26 may include a first aperture 30 formed through a top surface 32 and a second aperture 34 formed through a side surface 36. The top surface 32 may include a series of graduations 38 generally surrounding a perimeter of the first aperture 30, while the side surface 36 may likewise include a series of graduations 40 that generally surround an outer perimeter of the second aperture 34. The graduations 38, 40 may cooperate with the adjustment assembly 14 to position the illumination assembly 16 relative to the optical element 18, as will be described further below.

The main body 26 may also include a recess 42 having a series of steps 44. The recess 42 and steps 44 cooperate to allow the illumination assembly 16 to direct light generally from the main body 26 of the housing 12 toward the optical element 18. The recess 42 may be formed generally between a pair of attachment apertures 46 that are disposed generally within the recess 42 and between the main body 26 and the upwardly extending portion 28. The attachment apertures 46 selectively receive a pair of fasteners 48 that removably attach the housing 12 to the firearm 20.

In one configuration, the fasteners 48 include a threaded shank 50, a head portion 52, and a taper 54 extending generally between the threaded shank 50 and the head portion 52. The head portion 52 may include a hexagonal configuration 56 as well as a longitudinal slot 58 that cooperate with an external tool (not shown) to rotate the fasteners 48 relative to the main body 26 of the housing 12 and selectively attach the housing 12 to the firearm 20. The hexagonal configuration 56 may be used with a tool having a mating male portion while the longitudinal slot 58 may be used with a tool having a substantially flat male end. While the head portion 52 is described as including a hexagonal configuration 56 and a longitudinal slot 58 that receive tools having a respective mating configuration, the longitudinal slot 58 may be sized such that any flat surface can be used to rotate the fasteners 48 relative to the housing 12. For example, the longitudinal slots 58 may include a sufficient width and thickness to allow a spent shell casing to be used to rotate the fasteners relative to the housing 12.

Figure 3:
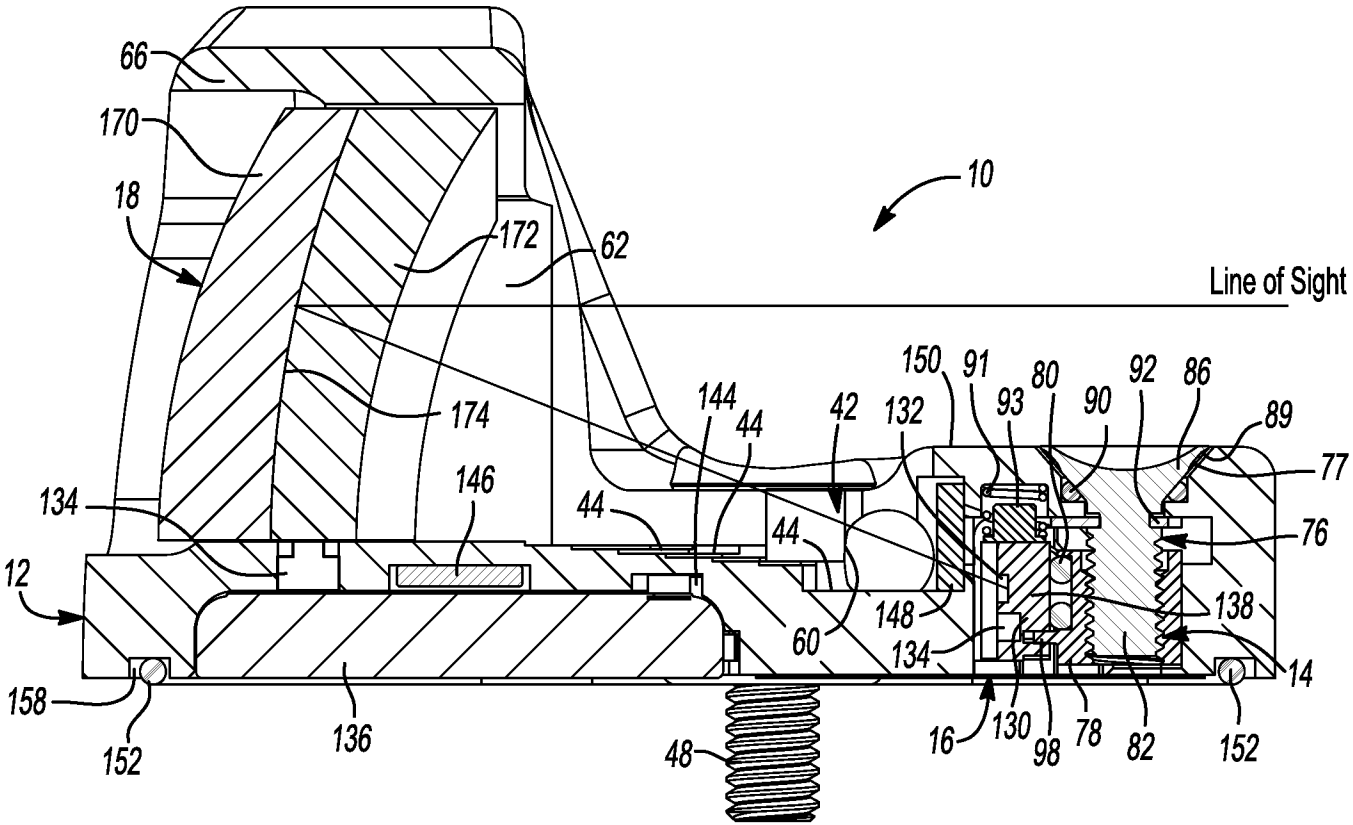
FIG. 3 is a cross sectional view of the optical sight of FIG. 1 taken along line A-A.

The main body 26 may also include at least one drain opening 60 formed therethrough and in communication with the recess 42. The drain openings 60 may be positioned relative to the recess 42 such that the drain openings 60 are in fluid communication with a lower-most step 44, as shown in FIG. 3. Positioning the drain opening 60 proximate to the lowest step 44 allows water that collects generally within the recess 42 and on any of the steps 44 to flow down to the lowest step 44 and be expelled from the housing 12 via the drain opening 60. Removing water from the housing 12 at the recess 42 improves the ability of the illumination assembly 16 in directing light toward the optical element 18 and prevents water from entering the housing 12.

Figure 4:
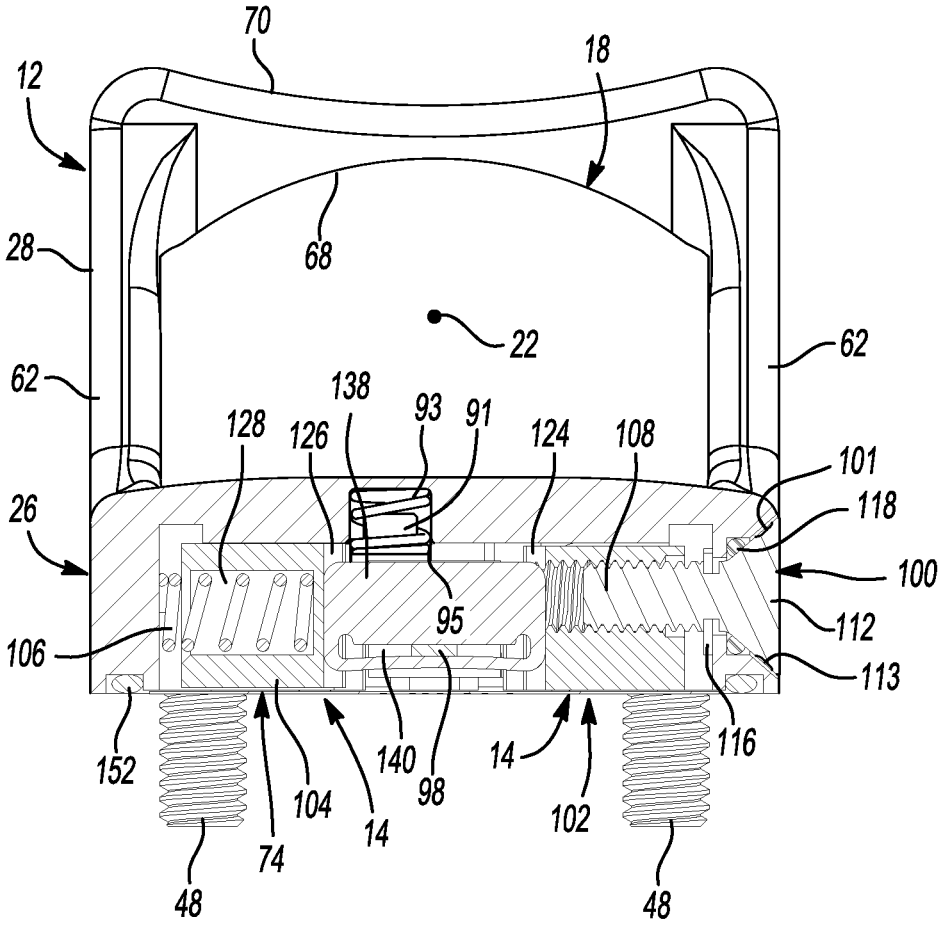
FIG. 4 is a cross sectional view of the optical sight of FIG. 1 taken along line B-B.
Figure 5:
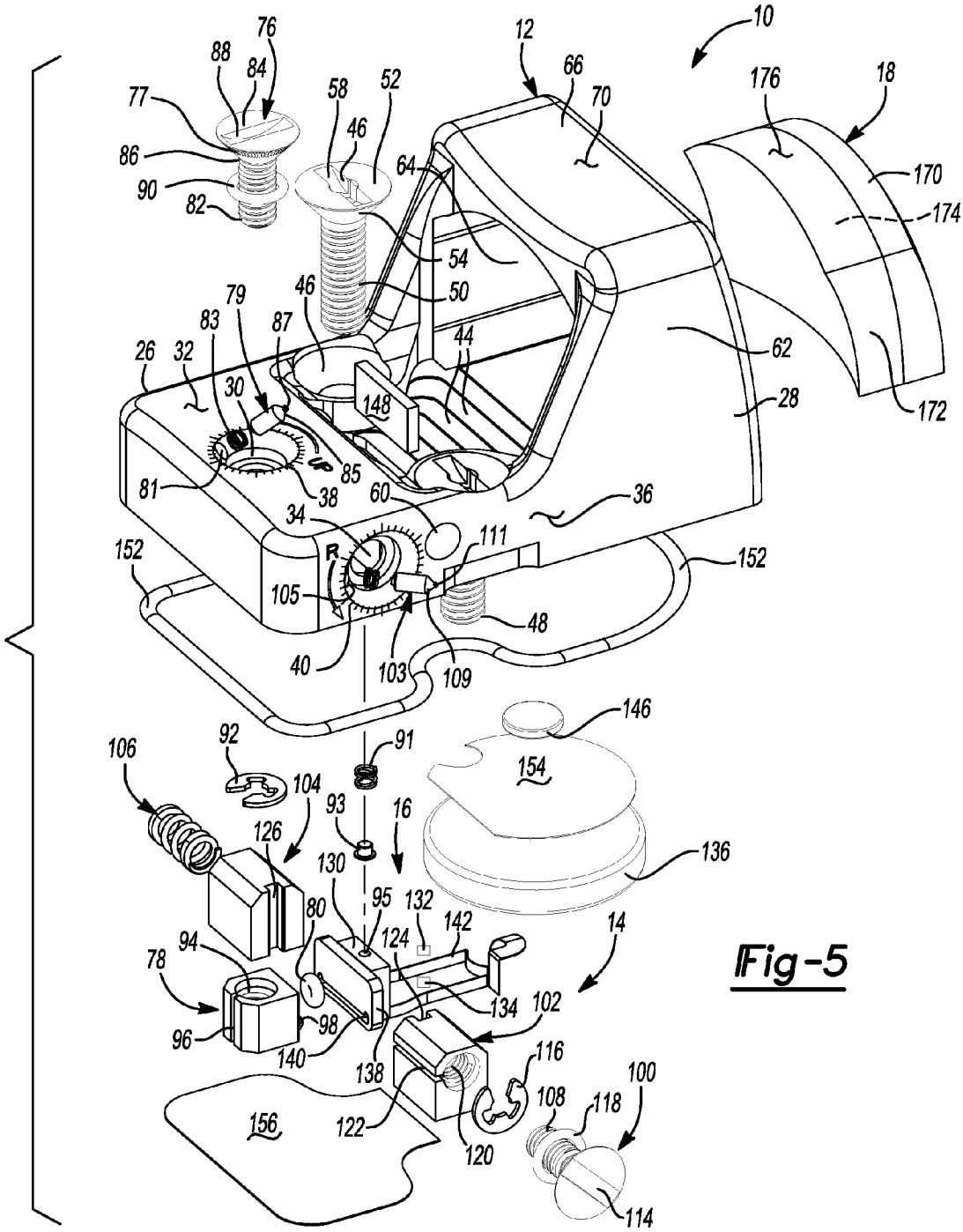
FIG. 5 is an exploded view of the optical sight of FIG. 1.
Figure 6:
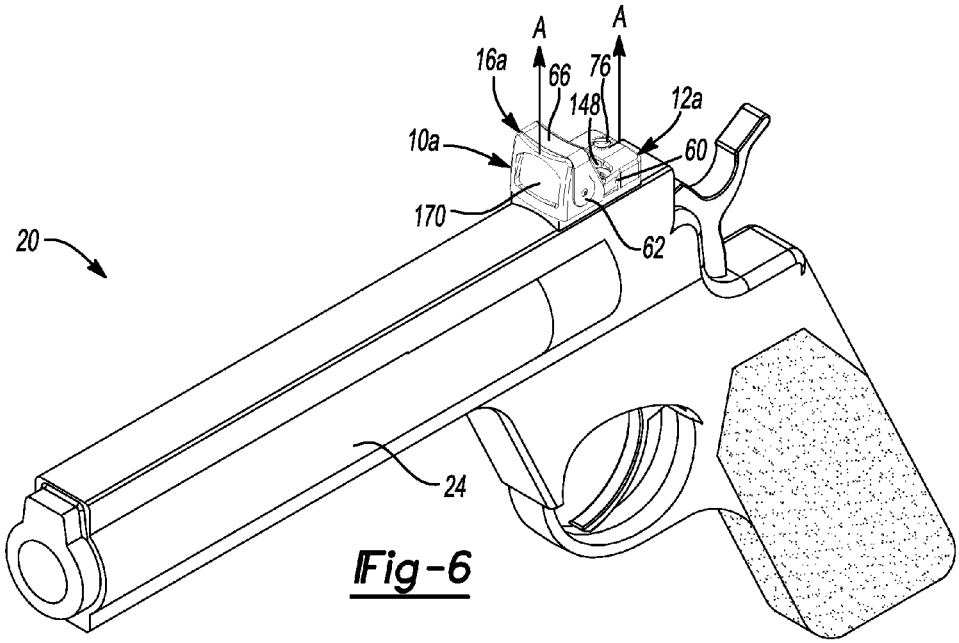
FIG. 6 is a perspective view of a firearm incorporating another optical sight in accordance with the principles of the present disclosure.
Figure 7:
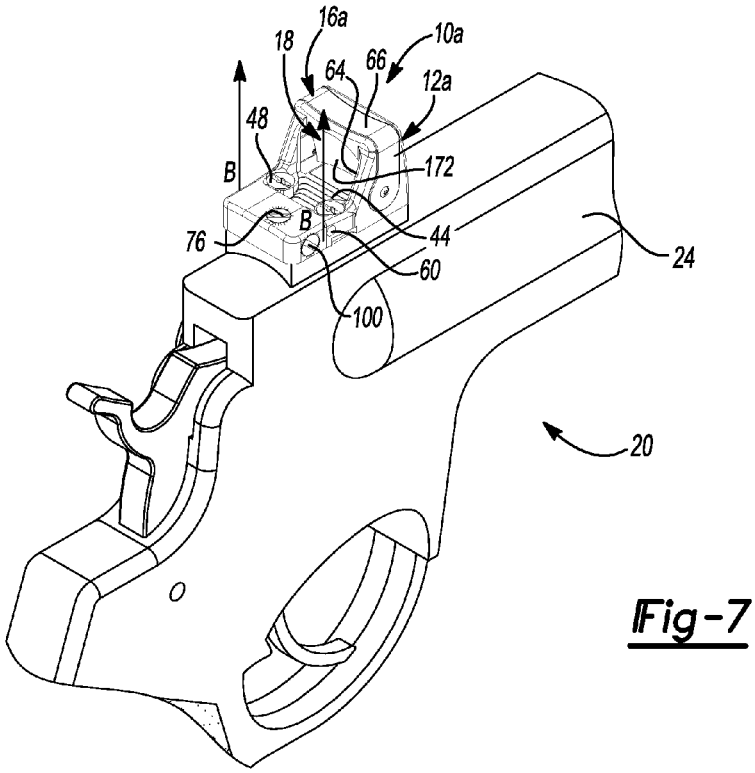
FIG. 7 is a perspective view of the firearm of FIG. 6 showing a rear portion of the optical sight.

With particular reference to FIGS. 4 and 5, the upwardly extending portion 28 is shown and may include a pair of posts 62, an opening 64, and a cross member 66 extending generally over the opening 64 and between the posts 62. The posts 62 may be formed at a substantially ninety degree angle relative to the main body 26 and may extend a predetermined distance above the opening 64. The opening 64 may include a generally D-shape to accommodate the optical element 18 therein. The cross member 66 provides the opening 64 with the D-shape and may include a bottom surface 68 opposing the opening 64 having a convex shape and a top surface 70 having a concave shape. The concave shape of the top surface 70 allows the top surface 70 to extend from the main body 26 a shorter distance than each of the posts 62. In other words, the posts 62 extend from the main body 26 a greater distance than does the top surface 70 of the cross member 66. As such, should the housing 12 be dropped such that the upwardly extending portion 28 contacts a hard surface, the force associated with the upwardly extending portion 28 contacting the hard surface is received by a distal end of each post 62 and is transmitted to the main body 26 rather than being received at the generally convex bottom surface 68 of the cross member 66. Transmitting forces generally away from the opening 64 and through the posts 62 toward the main body 26 protects the optical element 18 disposed within the opening 64 and prevents the optical element 18 from being fractured should the housing 12 be dropped or suffer an impact event.

The main body 26 and upwardly extending portion 28 may be integrally formed and may be formed of a one-piece metal construction. Forming the main body 26 and the upwardly extending portion 28 as a one-piece metal body strengthens the housing 12 and allows the housing 12 to withstand forces applied to either the main body 26 or the upwardly extending portion 28. In particular, forces applied to the posts 62 of the upwardly extending portion 28 are directly transferred from the upwardly extending portion 28 to the main body 26. Such forces are therefore diverted away from the optical element 18, thereby protecting the optical element 18, as described above. Forming the main body of a one-piece metal construction enhances the ability of the posts 62 in transmitting forces from a distal end of each post 62 to the main body 26.

The adjustment assembly 14 may be supported by the housing 12 and may adjust a position of the illumination assembly 16 relative to the housing 12 to adjust a position of the reticle 22 relative to the optical element 18. The adjustment assembly 14 may include a height-adjustment mechanism 72 that adjusts an UP/DOWN position of the reticle 22 and a windage-adjustment mechanism 74 that adjusts a left-right position of the reticle 22 relative to the optical element 18.

The height-adjustment mechanism 72 may include an adjustment screw 76, an adjuster block 78, and a biasing member 80. The adjustment screw 76 may be rotatably received within the first aperture 30 of the main body 26 and may be rotated relative to the graduations 38. The adjustment screw 76 may include a threaded body 82, a head 84, and a taper 86 extending generally between the threaded body 82 and the head 84. The head 84 may include a slot 88 to allow a tool (not shown) to be inserted into the head 84 to rotate the head 84 relative to the housing 12. A seal 90 may be disposed between the taper 86 of the adjustment screw 76 and an inner surface of the first aperture 30 to prevent debris from entering the main body 26. In one configuration, the seal 90 is an O-ring seal that is received generally around the taper 86 of the adjustment screw 76.

The taper 86 may also include a series of detents 77 in communication with a detent pin 79. The detent pin 79 may be slidably supported within a bore 81 of the housing 12, whereby the bore 81 is in communication with the first aperture 30 of the main body 26. A biasing member 83 such as, for example, a coil spring, may be disposed within the bore 81 and my impart a biasing force on the detent pin 79 to urge the detent pin 79 into the first aperture 30. When the screw 76 is inserted into the first aperture 30, a distal end of the detent pin 79 may engage the detents 77 formed in the taper 86 of the screw 76. When the screw 76 is rotated relative to the housing 12, the detent pin 79 is moved into an out of engagement with adjacent detents 77 and makes an audible noise to allow the user to know exactly how much the screw 76 has been rotated relative to the housing 12.

The detent pin 79 may include a tapered portion 85 terminating at a point 87 at a distal end of the detent pin 79. Likewise, each detent 77 may include a tapered surface 89, whereby the tapered portion 85 of the detent pin 79 engages the tapered surface 89 of a respective detent 77 to allow the screw 76 to be rotated in two directions relative to the housing 12 and to facilitate movement of the point 87 of the detent pin 79 into and out of each detent 77 when the screw 76 is rotated relative to the housing 12. The angle of the tapered portion 85 of the detent pin 79 and/or that of the tapered surface 89 of the detents 77 can be adjusted to either increase or decrease the force required to rotate the screw 76 relative to the housing 12 and/or to adjust the audible noise created when the screw 76 is rotated relative to the housing 12. Furthermore, the spring constant of the biasing member 83 may also be adjusted to both adjust the force required to rotate the screw 76 relative to the housing 12 as well as to adjust the audible noise created when the detent pin 79 moves from one detent 77 to an adjacent detent 77 caused by rotation of the screw relative to the housing 12.

A clip 92 may be received around a portion of the adjustment screw 76 generally at a location where the threaded body 82 meets the taper 86. The clip may secure the adjustment screw 76 to the main body 26 such that the adjustment screw 76 is prevented from being removed from the main body 26 while concurrently allowing the adjustment screw 76 to be rotated relative to the main body 26. In one configuration, the clip 92 is an E-clip that includes an opening that may be snapped into engagement with the adjustment screw 76 once the adjustment screw 76 is inserted into the first aperture 30 of the main body 26. Once the clip 92 is snapped into engagement with the adjustment screw 76, the adjustment screw 76 may be rotated relative to the main body 26 but may not be withdrawn from the first aperture 30 until the clip 92 is removed.

The adjuster block 78 may interact with the illumination assembly 16 to move the illumination assembly 16 up/down relative to the housing 12. The adjuster block 78 may include a threaded bore 94, a slot 96 in fluid communication with the threaded bore 94 and extending along the length of the threaded bore 94, and a projection 98. The adjustment screw 76 may be threadably received within the threaded bore 94 of the adjuster block 78 such that when the adjustment screw 76 is rotated relative to the housing 12, the adjuster block 78 is moved along an axis substantially perpendicular to the top surface 32 of the main body 26. Because the projection 98 is in engagement with the illumination assembly 16 and is fixed for movement with the adjuster block 78, movement of the projection 98 similarly causes the illumination assembly 16 to move relative to the housing 12.

The slot 96 allows the adjuster block 78 to compress generally around the threaded body 82 of the adjustment screw 76. Allowing the adjuster block 78 to compress and closely engage the threaded body 82 of the adjustment screw 76 maintains tight engagement between the adjuster block 78 and the adjustment screw 76.

The biasing member 80 may be disposed between the adjuster block 78 and the illumination assembly 16 and may bias the adjuster block 78 generally along the longitudinal axis of the housing 12 to account for any tolerances in the housing 12, illumination assembly 16, screw 76, and/or adjuster block 78. In one configuration, the biasing member 80 is an O-ring and applies a force on the adjuster block 78 to maintain the adjustment assembly 14 in a desired position in a direction substantially parallel to the longitudinal axis of the housing 12 (i.e., substantially parallel to a line of sight). Allowing the O-ring to impart a force on the adjuster block 78 maintains tight engagement between the adjustment screw 76 and the adjuster block 78 and therefore allows for precise manipulation and movement of the adjuster block 78 relative to the housing 12 while concurrently maintaining a desired position of the adjustment assembly 14 in the direction substantially parallel to the line of sight.

The position of the illumination assembly 16 relative to the housing 12 may be determined based on the position of the adjustment screw 76 relative to the housing 12. For example, the graduations 38 formed on the top surface 32 of the main body 26 may help in determining the relative position of the adjustment screw 76 relative to the main body 26 and, thus, the position of the illumination assembly 16 relative to the main body 26.

The graduations 38 may be permanently attached to the top surface 32 of the housing 12 either via paint and/or laser etching. As such, the graduations 38 maintain the same fixed position relative to the top surface 32 and allow a user to know precisely how much the adjustment screw 76 has moved relative to the housing 12. Furthermore, each graduation 38 may be positioned relative to each detent 77 such that each audible noise or "click" corresponds to movement of the screw 76 one graduation 38.

Once adjustment of the adjustment screw 76 is completed, the biasing member 80, in conjunction with the adjuster block 78, prevents unintended rotation of the adjustment screw 76 due to vibration and the like relative to the housing 12 and, as such, maintains the adjusted position of the adjustment screw 76.

A biasing member 91 may be used on conjunction with biasing member 80 to further maintain a position of the screw 76 relative to the housing 12. The biasing member 91 may apply a force on the adjuster block 78 and may be positioned between the adjuster block 78 and the housing 12 to exert a force on the adjuster block 78. In another configuration, the biasing member 91 may be positioned between a portion of the illumination assembly 16 and the housing 12 to indirectly impart a force on the adjuster block 78. In either configuration, the biasing member 91 may be a coil spring and may be positioned and held relative to the adjuster block 78 by a post 93 received within a bore 95 of either the adjuster block 78 or a component of the illumination assembly 16 (one or both of elements 130, 138 for example). Imparting a force on the adjuster block 78 likewise applies a force on the screw 76 and therefore resists relative movement between the screw 76 and the adjuster block 78.

With particular reference to FIGS. 4 and 5, the windage-adjustment mechanism 74 may include an adjustment screw 100, a first adjuster block 102, a second adjuster block 104, and a biasing member 106. The adjustment screw 100 may be of a similar construction to that of the adjustment screw 76 and may include a threaded body 108, a head 110, a taper 112 extending generally between the threaded body 108 and the head 110, and a slot formed in the head 110. As with the adjustment screw 76, the adjustment screw 100 may be rotated relative to the housing 12 but is not permitted to move along a longitudinal axis extending substantially perpendicular to the side surface 36 of the main body 26. A clip 116 may be disposed generally at a junction of the threaded body 108 and the taper 112 to permit rotational movement of the adjustment screw 100 relative to the main body 26 while concurrently preventing withdrawal of the adjustment screw 100 from the main body 26. The clip 116 may be received generally around the adjustment screw 100 once the adjustment screw 100 is inserted into the main body 26.

A seal 118 may be positioned generally between the head 110 of the adjustment screw 100 to prevent debris from entering the housing 12. The seal may engage the taper 112 of the adjustment screw 100 and may similarly engage a surface proximate to the second aperture 34 of the main body 26. In one configuration, the seal 118 is an O-ring and generally surrounds the taper 112 of the adjustment screw 100.

The taper 112 may include a series of detents 101 in communication with a detent pin 103. The detent pin 103 may be slidably supported within a bore 105 of the housing 12, whereby the bore 105 is in communication with the second aperture 34 of the main body 26. A biasing member 107 such as, for example, a coil spring, may be disposed within the bore 105 and my impart a biasing force on the detent pin 103 to urge the detent pin 103 into the second aperture 34. When the screw 100 is inserted into the second aperture 34, a distal end of the detent pin 103 may engage the detents 101 formed in the taper 112 of the screw 100. When the screw 100 is rotated relative to the housing 12, the detent pin 103 is moved into an out of engagement with adjacent detents 101 and makes an audible noise to allow the user to know exactly how much the screw 100 has been rotated relative to the housing 12.

The detent pin 103 may include a tapered portion 109 terminating at a point 111 at a distal end of the detent pin 103. Likewise, each detent 101 may include a tapered surface 113, whereby the tapered portion 109 of the detent pin 103 engages the tapered surface 113 of a respective detent 101 to allow the screw 100 to be rotated in two directions relative to the housing 12 and to facilitate movement of the point 111 of the detent pin 103 into and out of each detent 101 when the screw 100 is rotated relative to the housing 12. The angle of the tapered portion 109 of the detent pin 103 and/or that of the tapered surface 113 of the detents 101 can be adjusted to either increase or decrease the force required to rotate the screw 100 relative to the housing 12 and/or to adjust the audible noise created when the screw 100 is rotated relative to the housing 12. Furthermore, the spring constant of the biasing member 107 may also be adjusted to both adjust the force required to rotate the screw 100 relative to the housing 12 as well as to adjust the audible noise created when the detent pin 103 moves from one detent 101 to an adjacent detent 101 caused by rotation of the screw relative to the housing 12.

The first adjuster block 102 may include a threaded bore 120, a slot 122 extending generally along a length of and in fluid communication with the threaded bore 120, and a recess 124 formed in a body of the first adjuster block 102 in a direction substantially perpendicular to the slot 122. As with the adjuster block 78, the threaded body 108 of the adjustment screw 100 may be threadably received therein such that rotation of the adjustment screw 100 relative to the main body 26 causes the first adjuster block 102 to translate relative to the housing 12 along the longitudinal axis extending substantially perpendicular to the side surface 36. The slot 122 allows the adjuster block 102 to compress generally around the threaded body 108 of the adjustment screw 100 to maintain a tight engagement between the threaded bore 120 and the threaded body 108 of the adjustment screw 100. The recess 124 may receive a portion of the illumination assembly 16 such that when the first adjuster block 102 is translated relative to the housing 12, the illumination assembly 16 is similarly translated relative to the housing 12. Translating the illumination assembly 16 relative to the housing similarly causes the reticle 22 to be translated relative to the optical element 18 to adjust the position of the reticle 22 relative to the optical element 18. Adjusting the left/right position of the reticle 22 relative to the optical element 18 adjusts the "windage" of the optical sight 10.

The second adjuster block 104 is similar to the first adjuster block 102 with the exception that the second adjuster block 104 does not include a threaded bore. Rather, the second adjuster block 104 may include a recess 126 formed in an opposite side thereof as compared to the first adjuster block 102. The recess 126 allows the second adjuster block 104 to engage a portion of the illumination assembly 16 such that at least a portion of the illumination assembly 16 is disposed between the first and second adjuster blocks 102, 104, as shown in FIG. 5.

The biasing member 106 may be positioned generally between an inner wall of the main body 26 and the second adjuster block 104 and may cause the second adjuster block 104 to be biased toward the side surface 36 of the main body 26. As with the height-adjustment mechanism 72, imparting a bias on the adjuster blocks 102, 104 and, thus, the adjustment screw 100, prevents inadvertent rotation of the adjustment screw 100 relative to the housing 12. Preventing inadvertent rotation of the adjustment screw 100 relative to the housing 12 prevents unwanted movement of the reticle 22 relative to the optical element 18 and ensures that the set position of the adjustment screw 100 relative to the housing 12 is maintained. While the biasing member 106 is shown as being a coil spring, any biasing member that imparts a force on the adjuster blocks 102, 104 to urge the adjuster blocks generally toward the side surface 36 such as, for example, a linear spring, may be employed.

The graduations 40 that are permanently affixed to or formed in the side surface 36 of the housing 12 help facilitate adjustment of the adjustment screw 100 relative to the housing 12 and allow a user to visually observe the position of the adjustment screw 100 relative to the housing 12. As with the graduations 38, the graduations may be painted on and/or laser etched into the housing 12 such that the graduations 40 are permanently fixed relative to the housing 12. Furthermore, each graduation 40 may be positioned relative to each detent 101 such that each audible noise or "click" corresponds to movement of the screw 100 one graduation 40.

While the second adjuster block 104 may be a solid block such that the biasing member 106 engages an outer surface thereof to urge the second adjuster block toward the side surface 36, the second adjuster block 104 could alternatively include a bore 128 partially formed therethrough. The bore 128 may receive at least a portion of the biasing member 106 therein such that the biasing member 106 imparts a force on an end surface generally within the bore 128. Providing the second adjuster block 104 with an internal bore 128 reduces the weight of the second adjuster block 104 and, as such, reduces the overall weight of the optical sight 10.

With particular reference to FIGS. 3 and 5, the illumination assembly 16 is shown and may include a circuit board 130, an LED 132, a photo detector 134, and a power source 136. The circuit board 130 may be supported by a substrate 138 generally within the housing 12, which may include a slot 140 that slidably receives the projection 98 of the adjuster block 78. As described above, the adjuster block 78 may be moved up/down when the adjustment screw 76 is rotated relative to the housing 12. Because the projection 98 is received within the slot 140 of the substrate 138, up or down movement of the adjuster block 78 relative to the housing 12 causes concurrent up or down movement of the substrate 138 relative to the housing 12.

The projection 98 may be slidably received within the slot 140 to permit the substrate 138 to slide relative to the projection 98 when the first and second adjuster blocks 102, 104 are moved in the left/right directions relative to the housing 12. Furthermore, the substrate 138 may include a width substantially equal to a width of the recesses 124, 126 of the first and second adjuster blocks 102, 104 to allow the substrate 138 to be matingly received within the respective recesses 124, 126. Positioning the substrate 138 within each of the recesses 124, 126 of the respective adjuster blocks 102, 104 allows the substrate 138 to be moved along with the first and second adjuster blocks 102, 104 when the adjuster blocks 102, 104 are moved relative to the housing 12.

The circuit board 130 may be fixedly attached to the substrate 138 via epoxy or the like. As such, the circuit board 130 may be fixed for movement with the substrate 138 such that when the substrate 138 is moved by either the adjuster block 78 or the first and second adjuster blocks 102, 104, the circuit board 130 is moved therewith. The circuit board 130 may support the LED 132 and photo detector 134 such that movement of the circuit board 130 relative to the housing 12 causes concurrent movement of the LED 132 and photo detector 134 relative to the housing 12. In one configuration, the LED 132 and photo detector 134 are encapsulated on the circuit board 130 using a transparent epoxy or other coating. In another configuration, the LED 132 may be disposed proximate to the circuit board 130 and may be attached thereto while the photo detector 134 is disposed adjacent to the optical element 18 (FIG. 3). Positioning the photo detector 134 proximate to the optical element 18 allows light to be collected from multiple angles and be transmitted to the photo detector 134 via the optical element 18.

Regardless of the particular location of the photo detector 134, the LED 132 and photo detector 134 may be selectively controlled by the circuit board 130, whereby the photo detector 134 selectively causes the LED 132 to illuminate in response to ambient light conditions. Illumination of the LED 132 causes the LED 132 to direct light generally toward the optical element 18 to display the reticle 22 on the optical element 18.

The power source 136 may be in electrical communication with at least one of the circuit board 130, LED 132, and photo detector 134 via a contact strip 142. In one configuration, the power source 136 may be a battery having a generally circular shape. The battery may be received within a recess 144 of the housing 12 and may be held within the recess 144 by a magnet 146, which allows for removal and replacement of the battery when the battery requires replacement.

As described above, the circuit board 130, the LED 132, the photo detector 134, and the substrate 138 are disposed generally within the housing 12. The circuit board 130, LED 132, photo detector 134, and substrate 138 are protected from environmental conditions by a sight glass 148 that may be disposed generally between the LED 132 and the optical element 18. The sight glass 148 may be sealed against the housing 12 by an epoxy or other suitable adhesive. Positioning epoxy between the sight glass 148 and the housing 12 prevents debris from entering the housing 12 and contacting components of the illumination assembly 16 and adjustment assembly 14.

The housing 12 may include a projection 150 that extends generally over an edge of the sight glass to restrict water and other debris from contacting on an outer surface of the sight glass 148. Preventing water and other debris from contacting an outer surface of the sight glass 148 ensures that light from the LED 132 is not diverted or blocked and therefore reaches the optical element 18. Because the optical sight 10 may be used on a firearm 20 by law enforcement and/or military personnel, the optical sight 10 may be subjected to extreme weather conditions such as, for example, rain, wind, and ice. Providing the housing 12 with the projection 150 helps prevent such weather conditions from reaching the sight glass 148 and therefore improves the ability of the LED 132 in consistently providing light to the optical element 18 and displaying the reticle 22 thereon.

In addition to preventing intrusion of debris and/or fluid into the housing 12 at the sight glass 148, the illumination assembly 16 may be further protected from intrusion of such debris and/or fluid by providing an O-ring seal 152, a sticker 154, and a bottom cover or sticker 156. The stickers 154, 156 may be placed on a bottom portion of the housing 12 to seal components of the adjustment assembly 14 and/or illumination assembly 16 within the housing 12. The stickers 154,156 may be formed of a material that prevents a user from tampering with the components of the adjustment assembly 14 and/or illumination assembly 16 by forming the stickers 154, 156 of a material that tears if tampered with.

Figure 15:
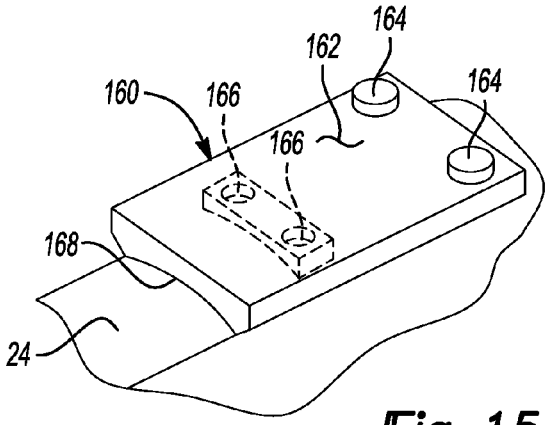
FIG. 15 is a perspective view of a base for use in supporting an optical sight in accordance with the principles of the present disclosure on a firearm.

The O-ring seal 152 may be received within a recess 158 (FIG. 3), which may surround an outer perimeter of a bottom portion of the housing 12. The O-ring seal 152 may engage an outer structure such as, for example, a base or mount 160, as shown in FIG. 15. The base 160 may include a generally flat upper surface 162, at least one projection 164, and at least one threaded aperture 166. In one configuration, the base 160 may include two projections 164 that are spaced to accommodate the O-ring seal 152. The projections 164 reduce the overall cost and complexity of manufacturing the base 160 and housing 12 when compared to mounts incorporating four or more projections.

The O-ring seal 152 may engage the upper surface 162 of the base 160 when the housing 12 is installed on the base 160. Prior to installation of the housing 12 on the base 160, the battery cover 154 may be placed generally over the power source 136 while the bottom cover 156 may be generally placed over a portion of the housing 12 proximate to the adjustment assembly 14 and illumination assembly 16. Once the O-ring seal 152, battery cover 154, and bottom cover 156 are installed on the housing 12, the housing 12 may be installed on the base 160.

The base 160 may include a lower surface 168 having a generally arcuate shape to accommodate an arcuate shape of a gun barrel 24. In another configuration, the bottom surface 168 of the base 160 may include a generally flat or planar surface to accommodate a barrel having a generally flat or planar top surface. In either configuration, the base 160 may be secured to the firearm 20 via at least one fastener (not shown). The housing 12 may be attached to the base 160 via the fasteners 48, which may be threadably received within the threaded apertures 166 of the base 160. In addition, the housing may include a pair of openings (not shown) that matingly engage the projections or posts 164 of the base 160 to prevent rotation or other movement of the housing 12 relative to the base 160 once the housing 12 is installed on the base 160.

With particular reference to FIGS. 3-5, the optical element 18 is shown to include a doublet lens having a first lens 170, a second lens 172, and a dichroic coating formed on at least one of the first and second lenses 170, 172 to allow light from the LED 132 to be reflected thereon. Coating one of the lenses 170, 172 with the dichroic coating 174 allows the LED 132 to generate the reticle 22 in an area generally between the lenses 170, 172 and therefore allows the reticle 22 to be displayed on the optical element 18. The lenses 170, 172 may include a substantially D-shape and may include an upper surface 176 having a generally convex shape. Once the optical element 18 is installed in the housing 12, the upper surface 176 of the optical element 18 may be positioned generally adjacent to the bottom surface 68 of the cross member 66.

The lenses 170, 172 may be spherical lenses, whereby at least one of the lenses 170, 172 includes a diameter substantially equal to 33.5 millimeters. Once the spherical lenses 170, 172 are formed, an overall height of the lenses 170, 172 may be substantially equal to 16.34 millimeters. Regardless of the exact size of the lenses 170, 172, the optical element 18 may include an effective focal length of 26.55 millimeters and may be formed from SCHOTT S-3 Grade A fine annealed material.

With particular reference to FIGS. 1-5, operation of the optical sight 10 will be described in detail. When the optical sight 10 is initially installed on the firearm 20, a flathead screwdriver, hexagonal screwdriver, or any generally flat member may be inserted into the hexagonal configuration 56 and/or longitudinal slot 58 to rotate the fasteners 48 relative to the housing 12. Sufficient rotation of the fasteners 48 relative to the housing 12 causes the threaded shank 50 of each fastener 48 to engage a respective threaded aperture 166 of the base 160. Once the fasteners 48 are sufficiently rotated relative to the housing 12, the head portion 52 of each fastener 48 generally engages the housing 12 at the taper 54 and secures the housing 12 to the base 160.

Once the housing 12 is secured to the base 160, adjustment of the position of the reticle 22 within the optical element 18 may be performed. Specifically, a flat tool such as, for example, a screwdriver or spent casing, may be inserted into the slot 88 of the adjustment screw 76 to rotate the adjustment screw 76 relative to the housing 12. As described above, rotation of the adjustment screw 76 relative to the housing 12 causes up/down movement of the adjuster block 78 relative to the housing 12. Movement of the adjuster block 78 in the up direction may be accomplished by rotation of the adjustment screw 76 in a clockwise direction, as shown in FIG. 5. If movement of the adjustment screw 76 in the clockwise direction causes upward movement of the adjuster block 78, counterclockwise rotation of the adjustment screw 76 would cause downward movement of the adjuster block 78 relative to the housing 12.

Because the projection 98 of the adjuster block 78 is slidably received within the slot 140 of the substrate 138, up/down movement of the adjuster block 78 relative to the housing 12 causes likewise movement of the substrate 138 relative to the housing 12. Moving the substrate 138 relative to the housing 12 causes concurrent movement of the circuit board 130, LED 132, and photo detector 134 relative to the housing 12. By moving the LED 132 with the substrate 138 and adjuster block 78, movement of the light transmitted by the LED 132 is similarly adjusted. Because this light generates the reticle 22 on the optical element 18, up/down movement of the LED 132 relative to the housing 12 causes concurrent up/down movement of the reticle 22 relative to the optical element 18. Once the user properly aligns the reticle 22 in the up/down position relative to the optical element 18, the flathead screwdriver or spent casing may be removed from the slot 88 of the adjustment screw 76. The adjustment screw 76 will be maintained in the set position based on engagement of the biasing member 80 with the adjuster block 78 and housing 12.

Once the up/down adjustment of the reticle 22 is accomplished, the flathead screwdriver or spent casing may be inserted into the slot 114 of the adjustment screw 100. Rotation of the adjustment screw 100 by the flathead screwdriver or spent casing causes the first and second adjuster blocks 102, 104 to move relative to the housing 12. As described above, movement of the adjuster blocks 102, 104 relative to the housing 12 causes concurrent movement of the substrate 138 relative to the housing 12. Because the circuit board 130, LED 132, and photo detector 134 may be attached to the substrate 138, movement of the substrate 138 relative to the housing 12 causes concurrent movement of the circuit board 130, LED 132, and photo detector 134.

Moving the LED 132 relative to the housing 12 likewise causes movement of the light generated by the LED 132 to move relative to the housing 12. Movement of the light from the LED 132 relative to the housing 12 causes the light to move relative to the optical element 18 and therefore adjusts the left/right position (i.e., the "windage") of the reticle 22 relative to the optical element 18. For example, if the adjustment screw 100 is rotated in the counterclockwise direction and the LED 132 is moved generally to the right rotation of the adjustment screw 100 in the clockwise direction will cause movement of the LED 132 to the left.

Once the windage of the reticle 22 is adjusted, the flathead screwdriver or spent shell casing may be removed from the slot 114 of the adjustment screw 100. As described above, the biasing member 106 imparts a force on the first and second adjuster blocks 102, 104 and substrate 138 and therefore locks the position of the adjustment screw 100. As such, the set position of the adjustment screw 100 and, thus, the LED 132, is maintained when the flathead screwdriver or spent shell casing is removed from engagement with the adjustment screw 100. While adjustment of the reticle 22 in the up/down direction is described as being performed prior to adjustment of the windage of the reticle 22, adjustment of the windage of the reticle 22 could be performed prior to or concurrently with adjustment of the up/down direction of the reticle 22.

Once the position of the reticle 22 is adjusted relative to the optical element 18, the optical sight 10 may be used to properly align the barrel 24 of the firearm 20 relative to a target (now shown). In operation, the photo detector 134 senses ambient light conditions and adjusts the amount of power supplied to the LED 132 from the power source 136. For example, in bright conditions, the photo detector 134 may supply the LED 132 with more power from the power source 136 to illuminate the reticle 22 at a higher intensity to allow the reticle 22 to stand out under such high ambient light conditions. Conversely, when ambient light conditions are low, the photo detector 134 may supply the LED 132 with less power from the power source 136, as less illumination of the reticle 22 is required to allow the reticle 22 to be seen.

In either of the foregoing conditions, the LED 132 supplies light generally through the sight glass 148 and above the steps 44 of the main body 26 towards the optical element 18. Because the optical element 18 includes a dichroic coating 174 disposed on at least one of the first lens 170 and the second lens 172, the wave length of the light from the LED 132 is reflected and causes the reticle 22 to appear in the optical element 18 along the line-of-sight shown in FIG. 3. The reticle 22 may be used by the user to align the barrel 24 of the firearm 20 with a target.

With particular reference to FIGS. 6-10, an optical sight 10*a* is provided. In view of the substantial similarity in structure and function of the components associated with the optical sight 10 with respect to the optical sight 10*a*, like reference numerals are used hereinafter and in the drawings to identify like components while like reference numerals containing letter extensions are used to identify those components that have been modified.

As with the optical sight 10, the optical sight 10*a* may include a housing 12*a*, an adjustment assembly 14*a*, an illumination assembly 16*a*, and an optical element 18. The optical sight 10*a* may be mounted to a firearm 20 via a base 160 through engagement of fasteners 48 with threaded apertures 166 of the base 160.

The housing 12*a* may include a main body 26 and an upwardly extending portion 28*a*. The upwardly extending portion 28*a* may include a pair of posts 62*a* and a cross member 66*a*. As with the optical sight 10*a*, the posts 62*a* extend generally from the main body 26 a greater distance than the cross member 66*a*. As such, the cross member 66*a* may include a generally concave shape, whereby a center portion of the cross member 66*a* extends below distal ends of each of the posts 62*a*.

A channel 178 may extend from each post 62*a* into the cross member 66*a* for receiving at least a portion of the illumination assembly 16*a*. Furthermore, each post 62*a* may include an attachment aperture 180 for securing at least a portion of the illumination assembly 16*a* to the upwardly extending portion 28*a* of the housing 12*a*.

The illumination assembly 16*a* may be received at least partially within the channel 178 of the upwardly extending portion 28*a* and may include a fiber optic 182, a fiber optic sticker 184, and a fiber cover 186. The illumination assembly 16*a* may be of the type disclosed in assignee's commonly owned U.S. Pat. No. 5,653,034, the disclosure of which is incorporated herein by reference.

The fiber optic 182, fiber optic sticker 184, and fiber cover 186 may be at least partially disposed within the channel 178. In another configuration, the fiber optic 182, fiber optic sticker 184, and fiber cover 186 may be completely disposed within the channel 178 such that an outer surface of the fiber cover 186 is substantially flush with an outer surface of each post 62*a* and a top portion of the cross member 66*a*. In another configuration, the fiber optic 182, fiber optic sticker 184, and fiber cover 186 may protrude from an outer surface of both of the posts 62*a* from a surface of the cross member 66*a* to permit more light to be gathered by the fiber optic 182.

Figure 10:
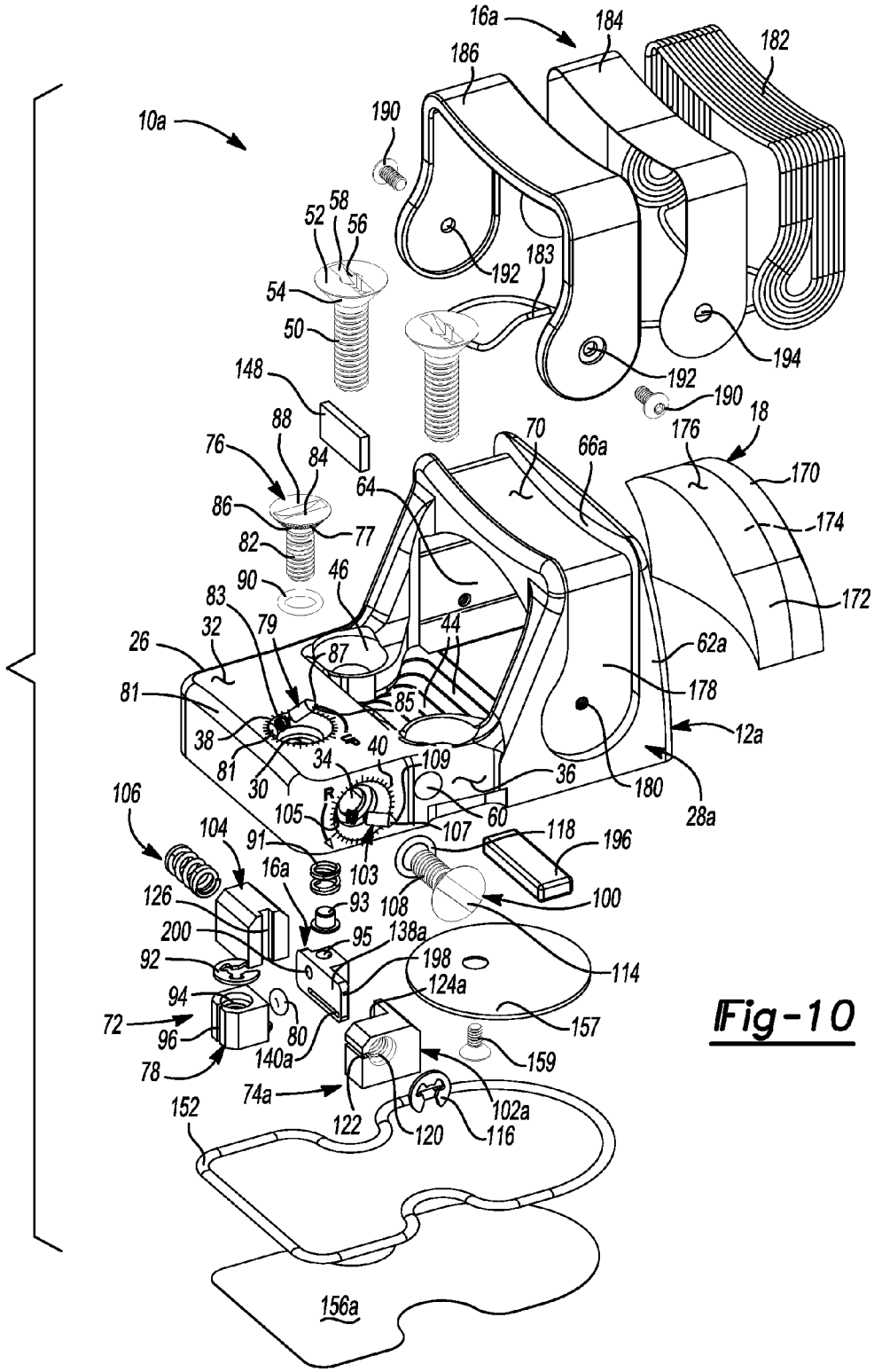
FIG. 10 is an exploded view of the optical sight of FIG. 6.

As shown in FIG. 10, the fiber optic 182 is a substantially elongate fiber that may be wrapped multiple times and be positioned and shaped within the channel 178. The fiber optic 182 may extend from a bottom portion of one of the posts 62*a* and into a recess 188. From the recess 188, the fiber optic 182 may pass through a central portion of the main body 26 and be received proximate to a portion of the adjustment assembly 14*a* to allow light from the fiber optic 182 gathered at the posts 62*a* and cross member 66*a* to be displayed through the sight glass 148 and onto the optical element 18 via a distal end 183 of the fiber optic 182.

Once the fiber optic 182 is positioned properly relative to the upwardly extending portion 28*a* and recess 188, the fiber optic 182 may be secured to the housing 12*a* by inserting a pair of fasteners 190 through apertures 192 of the fiber cover 186 and through apertures 194 of the fiber optic sticker 184 to fix the fiber optic 182 relative to the posts 62*a* and cross member 66*a*.

In addition to the fiber optic 182, fiber optic sticker 184, and fiber cover 186, the illumination assembly 16*a* may also include a tritium lamp 196. The tritium lamp 196 may be disposed generally within the recess 188 of the housing 12*a* and may be disposed proximate to or in contact with the fiber optic 182 disposed within the recess 188. The tritium lamp 196 may cooperate with the fiber optic 182 to direct light through the sight glass 148 and toward the optical element 18.

In addition to the tritium lamp 196, the illumination assembly 16*a* may also include an LED (not shown) that can be used in conjunction with or in place of the fiber optic 182 and tritium lamp 196. For example, if light from the fiber optic 182 and/or tritium lamp 196 is insufficient, the LED may be energized to illuminate the reticle 22. Generally speaking, the illumination assembly 16*a* may illuminate the reticle 22 via any combination of the fiber optic 182, tritium lamp 196, and LED.

The particular configuration of the chosen light source (i.e., fiber optic 182, tritium lamp 196, and/or LED) may depend on ambient-light conditions. For example, when ambient-light conditions are dark, the LED may be required to supplement the fiber optic 182 and/or tritium lamp 196. Conversely, when ambient-light conditions are light, the LED and tritium lamp 196 may not be required, as sufficient light may be collected and transmitted via the fiber optic 182 alone.

A sticker 156*a* may be placed on a bottom portion of the housing 12*a* to seal components within the housing 12*a*. The sticker 156*a* may be formed of a material that prevents a user from tampering with the components of the adjustment assembly 14*a* and/or illumination assembly 16*a* by forming the sticker 156*a* from a material that tears if tampered with. In addition, a lamp cover 157 may be positioned on a bottom portion of the housing 12*a* to seal recess 188. The lamp cover 157 may be removably attached to the housing 12*a* via a suitable fastener 159.

Figure 8:
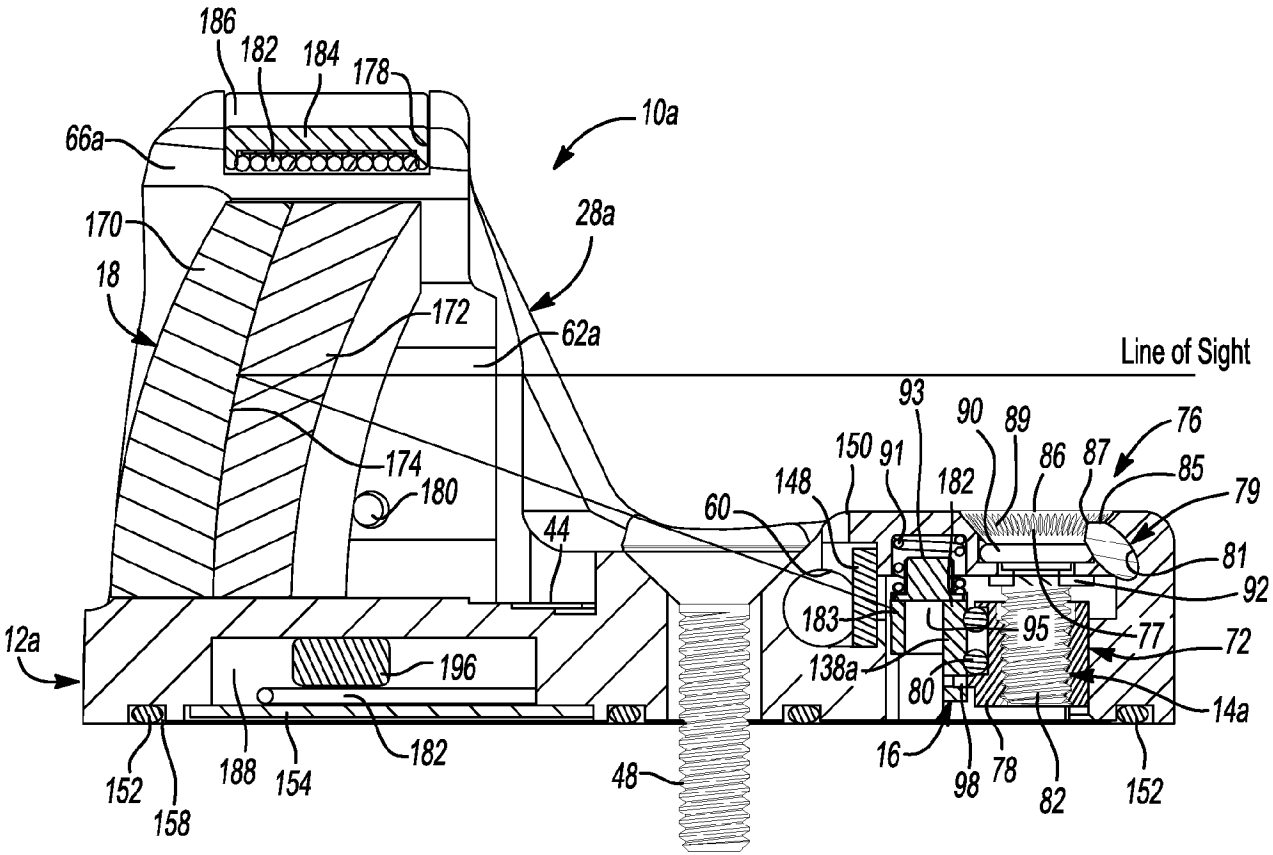
FIG. 8 is a cross sectional view of the optical sight of FIG. 6 taken along line A-A.
Figure 9:
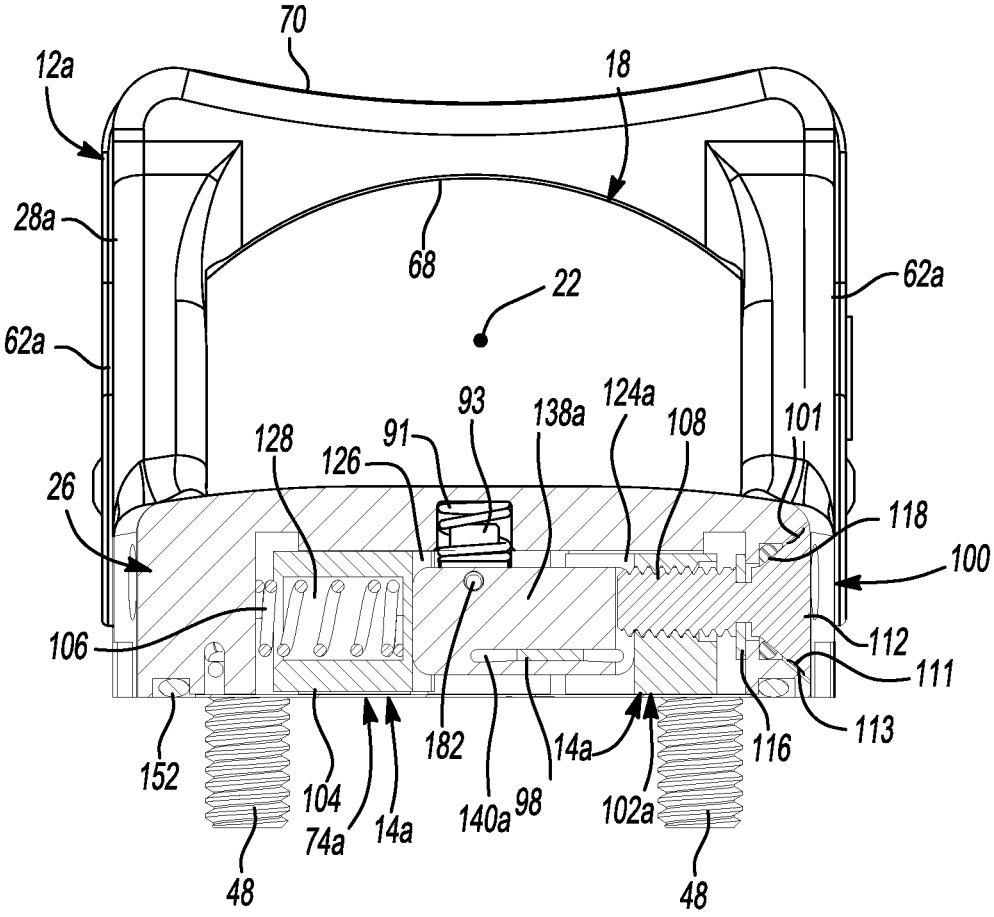
FIG. 9 is a cross sectional view of the optical sight of FIG. 6 taken along line B-B.

With continued reference to FIGS. 8-10, the adjustment assembly 14*a* is provided and may include a height-adjustment mechanism 72 and a windage-adjustment mechanism 74*a*. The windage-adjustment mechanism 74*a* may include a first adjuster block 102*a* and a second adjuster block 104. As with the first and second adjuster blocks 102*a*, 104 of the optical sight 10*a*, the first adjuster block 102*a* and second adjuster block 104 may be in contact with the illumination assembly 16*a* to selectively adjust a left/right position of light supplied to the optical element 18 by the illumination assembly 16*a*.

The first adjuster block 102*a* may include a recess 124*a* having a different shape than the recess 124 of the first adjuster block 102 that accommodates a substrate 138*a* of the illumination assembly 16*a*. Specifically, the recess 124*a* of the first adjuster block 102*a* may include a shape that matingly engages the substrate 138*a* to allow the substrate 138*a* to be moved concurrently with the first adjuster block 102*a*.

The substrate 138*a* may include an extension 198 and an aperture 200, whereby the extension 198 is received generally within the recess 124*a* of the first adjuster block 102*a*. The aperture 200 may be formed through the substrate 138*a* and may receive a distal end 183 of the fiber optic 182.

With continued reference to FIGS. 8-10, operation of the optical sight 10*a* will be described in detail. Once the optical sight 10*a* is mounted to the base 160 via fasteners 48, the optical sight 10*a* may be adjusted to properly align the position of the reticle 22 relative to the barrel 24 of the firearm 20. A flathead screwdriver or other generally flat member may be inserted into the slot 88 of the adjustment screw 76 to rotate the adjustment screw 76 relative to the housing 12*a*. Rotation of the adjustment screw 76 relative to the housing 12*a* causes concurrent up/down movement of the adjuster block 78 relative to the housing 12*a*. Because the projection 98 of the adjuster block 78 is slidably received within a slot 140*a* of the substrate 138*a*, the substrate 138*a* is caused to move concurrently in the up or down direction with the adjuster block 78.

Movement of the substrate 138*a* in either the up or down direction causes concurrent movement of the aperture 200 in the up or down direction. Because the distal end 183 of the fiber optic 182 is received within the aperture 200, the distal end 183 of the fiber optic 182 is similarly caused to move in either the up or down direction. The distal end 183 of the fiber optic 182 outputs light collected by the fiber optic 182 at the posts 62*a*, at the cross member 66*a*, or from the tritium lamp 196 generally through the sight glass 148 and toward the optical element 18 to generate the reticle 22 on the optical element 18. Therefore, up or down movement of the substrate 138*a* and distal end 183 of the fiber optic 182 causes concurrent up or down movement of the reticle 22 on the optical element 18.

Once the position of the reticle 22 is adjusted in the up/down direction, the flathead screwdriver or flat tool may be removed from engagement with the adjustment screw 76. As with the height-adjustment mechanism 72 of the optical sight 10, the up/down position of the reticle 22 relative to the optical element 18 is maintained due to the force imparted on the adjuster block 78 by biasing members 80, 91. Specifically, biasing member 80 applies a force on the adjuster block 78 between the substrate 138*a* and the adjuster block 78 while biasing member 91 applies a force directly on substrate 138*a*, which in turn applies a force on the adjuster block 78 due to engagement between projection 98 of the adjuster block 78 and slot 140*a* of the substrate 138*a*.

The left/right (i.e., windage) of the reticle 22 may be adjusted by inserting a flathead screwdriver or other flat object into the slot 114 of the adjustment screw 100. Once the flathead screwdriver or other flat member is inserted into the slot 114 of the adjustment screw 100, rotation of the adjustment screw 100 relative to the housing 12*a* causes concurrent movement of the first and second adjuster blocks 102*a*, 104. Movement of the adjuster blocks 102*a*, 104 causes concurrent movement of the substrate 138*a* relative to the housing 12*a* in a direction toward and away from the side surface 36 of the main body 26. Because the substrate 138*a* supports the distal end 183 of the fiber optic 182, movement of the substrate 138*a* in either the left or right direction relative to the housing 12*a* similarly causes movement of the distal end 183 of the fiber optic 182 relative to the housing 12*a*. As described above, movement of the distal end 183 of the fiber optic 182 relative to the housing 12*a* causes concurrent movement of the reticle 22 relative to the optical element 18. Once the position of the reticle 22 relative to the optical element 18 is adjusted, the flathead screwdriver or flat tool may be removed from engagement with the adjustment screw 100. As with the windage-adjustment mechanism 74 of the optical sight 10, the set position of the windage is maintained due to the force imparted on the first and second adjuster blocks 102*a*, 104 by the biasing member 106.

Once the up/down position and windage position of the reticle 22 is properly adjusted relative to the optical element 18, the optical sight 10 may be used to align the barrel 24 of the firearm 20 relative to a target (not shown).

The reticle 22 may be illuminated by a combination of the fiber optic 182 and the tritium lamp 196 or may be illuminated solely by the fiber optic 182 or solely by the tritium lamp 196. For example, in high ambient light conditions, sufficient light may be captured by the fiber optic 182 and directed through the distal end 183 of the fiber optic 182 toward the optical element 18 such that the tritium lamp 196 is not used at all or is only partially used. Under dark conditions where ambient light is low, the fiber optic 182 may not be able to capture enough light to supply the distal end 183 of the fiber optic 182 with sufficient light to illuminate the reticle 22 on the optical element 18. Under such dark conditions, the tritium lamp 196 may be used in conjunction with the fiber optic 182 to sufficiently illuminate the reticle 22. Under certain circumstances, if the firearm 20 is used in total darkness, the tritium lamp 196 may be exclusively used, whereby light is not captured by the fiber optic 182. Rather, light emanating from the distal end 183 of the fiber optic 182 is generated solely by the tritium lamp 196. Under most conditions, however, light supplied at the distal end 183 of the fiber optic 182 will come from a combination of light gathered by the fiber optic 182 and received from the tritium lamp 196.

Because the optical element 18 includes a dichroic coating 174 disposed on at least one of the first lens 170 and the second lens 172, the wave length of the light from the fiber optic 182 and/or tritium lamp 196 is reflected and causes the reticle 22 to appear in the optical element 18 along the line-of-sight shown in FIG. 8. The reticle 22 may be used by the user to align the barrel 24 of the firearm 20 with a target.

Figure 11:
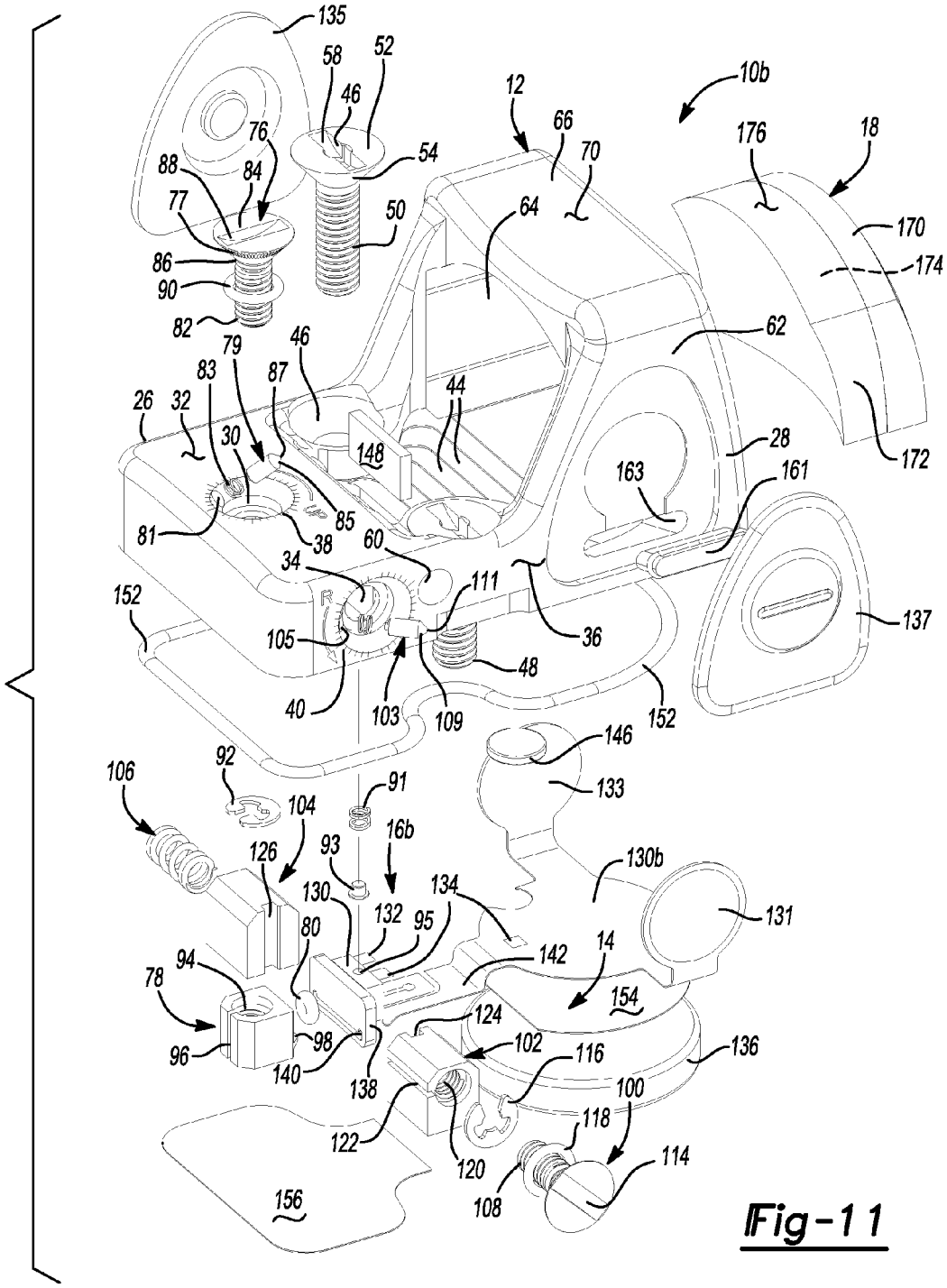
FIG. 11 is an exploded view of an optical sight in accordance with the principles of the present disclosure.

With particular reference to FIG. 11, an optical sight 10*b* is provided. In view of the substantial similarity in structure and function of the components associated with the optical sight 10 with respect to the optical sight 10*b*, like reference numerals are used hereinafter and in the drawings to identify like components while like reference numerals containing letter extensions are used to identify those components that have been modified.

As with the optical sight 10, the optical sight 10*b* may include a housing 12, an adjustment assembly 14, an illumination assembly 16*b*, and an optical element 18. The optical sight 10*b* may be mounted to a firearm 20 via a base 160 through engagement of fasteners 48 with threaded apertures 166 of the base 160.

The illumination assembly 16*b* may include a flexible circuit board 130*b*, an LED 132, a photo detector 134, and a power source 136. The flexible circuit board 130*b* may extend generally under the optical element 18 and may include a first actuation member 131 and a second actuation member 133. Each actuation member 131, 133 may be used to control illumination of the LED 132 and photo detector 134 and each may be associated with a cover 135, 137.

In one configuration, the first and second actuation members 131, 133 may be button switches in contact with respective covers 135, 137. The covers 135, 137 may be formed from a flexible material such as rubber or plastic such that when a force is applied to either cover 135, 137, the respective cover 135, 137 deflects and transmits the applied force to the associated actuation member 131, 133. When either cover 135, 137 is depressed, the actuation member 131, 133 associated with the particular cover 135, 137 is actuated to control operation of the LED and/or photo detector 134. Such control may be facilitated by providing descriptive markings on at least one of the covers 135, 137. For example, providing one actuation member 131 with a positive sign (+) and providing the other actuation member 133 with a negative sign (−) provides the user with a quick reference as to which cover 135, 137 and associated actuation member 131, 133 increases (+) or decreases (−) illumination.

As with the illumination assembly 16, the illumination assembly 16*b* may similarly be protected from debris and/or fluid by providing an O-ring seal 152, a sticker 154, and a bottom cover or sticker 156. The stickers 154, 156 may be placed on a bottom portion of the housing 12 to seal components of the adjustment assembly 14 and/or illumination assembly 16*a* within the housing 12.

The illumination assembly 16*b* may also include at least one plug 161 that is inserted into a slot 163 formed through the housing 12 in an area proximate to each actuation member 131, 133. The slot 163 allows each actuation member 131, 133 to extend through the housing 12 and be positioned proximate to a cover 135, 137. The plug 161 maintains the sealed nature of the housing 12 to prevent intrusion of water and other debris from entering the housing 12 and contacting the adjustment assembly 14 and/or illumination assembly 16*b*.

One end of the circuit board 130*b* may be fixedly attached to the substrate 138 via epoxy or the like. As such, the circuit board 130 may be fixed for movement with the substrate 138 such that when the substrate 138 is moved by either the adjuster block 78 or the first and second adjuster blocks 102, 104, the circuit board 130*b* is moved therewith. The circuit board 130*b* may support the LED 132 and photo detector 134 such that movement of the circuit board 130*b* relative to the housing 12 causes concurrent movement of the LED 132 and photo detector 134 relative to the housing 12. In one configuration, the LED 132 and photo detector 134 are encapsulated on the circuit board 130*b* proximate to the substrate 138 using a transparent epoxy or other coating. In another configuration, the LED 132 may be disposed on the circuit board 130*b* and may be attached thereto proximate to the substrate 138 while the photo detector 134 is disposed adjacent to the optical element 18.

While the photo detector 134 is described as being positioned proximate to either the substrate 138 or the optical element 18, the photo detector 134 could be positioned anywhere on the circuit board 130*b* as long as the photo detector 134 is exposed to ambient light.

Regardless of the particular location of the photo detector 134, the LED 132 and photo detector 134 may be selectively controlled by the circuit board 130*b*, whereby the photo detector 134 selectively causes the LED 132 to illuminate in response to ambient-light conditions. Illumination of the LED 132 causes the LED 132 to direct light generally toward the optical element 18 to display the reticle 22 on the optical element 18.

The flexible circuit board 130*b* may be configured such that the illumination assembly 16*b* may operate in either an automatic mode or a manual mode. For example, when the illumination assembly 16*b* is initially activated by depressing either cover 135, 137, the illumination assembly 16*b* may default to the automatic mode. In the automatic mode, the intensity of the LED 132 is controlled based on ambient-light conditions, as detected by the photo detector 134.

The automatic mode may be overridden by depressing either cover 135, 137 such that one of the actuation members 131, 133 is actuated. Depressing either cover 135, 137 during the automatic mode may cause the illumination assembly 16*b* to enter the manual mode, whereby the intensity of the LED 132 is controlled based on manual input to either or both of the actuation members 131, 133 of the circuit board 130*b* via depression of covers 135, 137. During the manual mode, light intensity is not controlled based on ambient-light conditions and is not controlled based on information received from the photo sensor 134. For example, depression of cover 137 and associated actuation member 131 causes the intensity of the LED 132 to be reduced. Similarly, depression of cover 135 and associated actuation member 133 causes the intensity of the LED 132 to be increased.

The circuit board 130*b* may also be configured such that when the covers 135, 137 are simultaneously depressed for a first predetermined time period the illumination assembly 16*b* returns to the automatic mode and when depressed for a second predetermined time period turns off. In one configuration, the first predetermined time period is any time less than approximately three (3) seconds while the second predetermined time period is approximately equal to three (3) seconds or more.

Figure 12A:
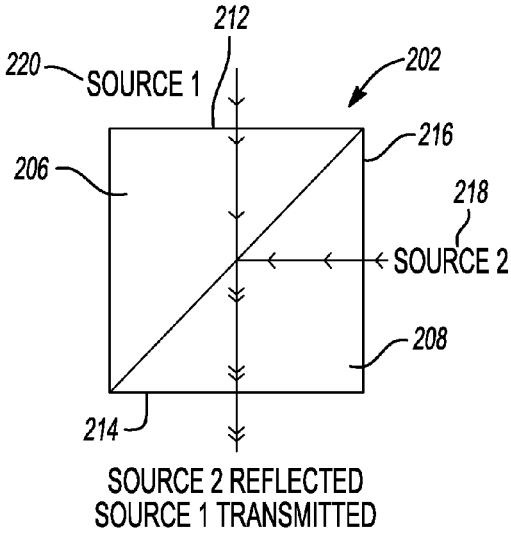
FIG. 12A is a schematic representation of a beam splitter for use with an optical sight in accordance with the principles of the present disclosure.

With particular reference to FIGS. 12A-12D, 13, and 14, variations of the illumination assembly 16*a* are provided. FIG. 12A shows a beam splitter 202, which includes a coating 204 disposed generally between first and second halves 206, 208 of the beam splitter 202, whereby the beam splitter halves 206, 208 are right-angled prisms. The beam splitter 202 may be of the type disclose in assignee's commonly owned U.S. Pat. No. 6,807,742, the disclosure of which is incorporated herein by reference.

Figure 12B:
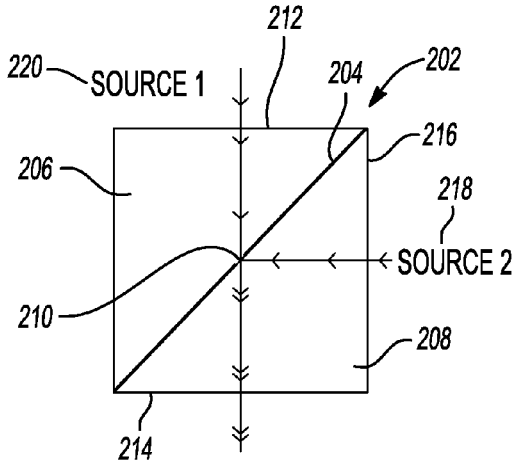
FIG. 12B is a schematic representation of a beam splitter incorporating a mask and reticle configuration for use with an optical sight in accordance with the principles of the present disclosure.
Figure 12C:
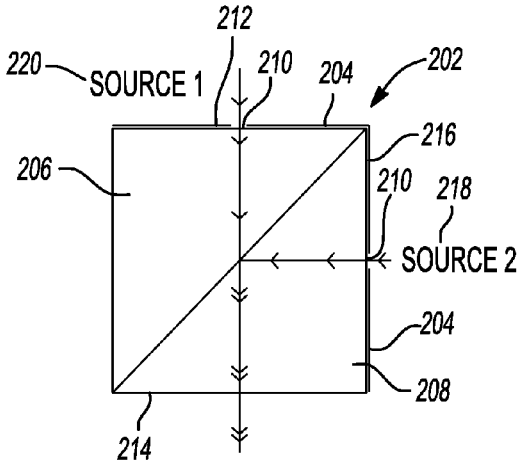
FIG. 12C is a schematic representation of a beam splitter incorporating a mask and reticle configuration for use with an optical sight in accordance with the principles of the present disclosure.
Figure 12D:
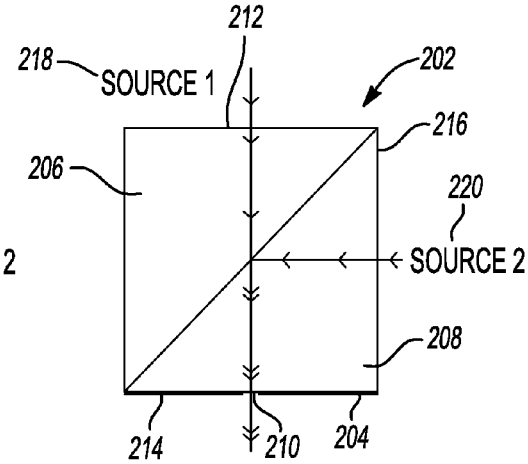
FIG. 12D is a schematic representation of a beam splitter incorporating a mask and reticle configuration for use with an optical sight in accordance with the principles of the present disclosure.

The coating 204 may include an opening 210 defining the shape of the reticle 22 (see FIG. 12B). In another configuration, the coating may be on surfaces 212 and 216 (see FIG. 12C) and in yet another configuration, the coating may be on surface 214 (see FIG. 12D). In either of the foregoing configurations, the reticle 22 may include any shape. If the coating including the opening defining the reticle 22 is on a pair of surfaces such as, for example, surfaces 212 and 216, the coating (204; i.e., mask) must be applied such that the opening for defining the reticle 22 is exactly aligned to ensure that the reticle 22 is clearly shown on the optical element 18.

FIG. 12A provides an example, whereby light from SOURCE 1 220 is combined with light from SOURCE 2 218, whereby SOURCE 1 220 is one of a fiber optic, an LED, and a tritium lamp and SOURCE 2 218 is one of a fiber optic, an LED, and a tritium lamp. As shown in FIG. 12A, light from SOURCE 2 218 may be completely transmitted while light from SOURCE 1 220 may be completely reflected. Alternatively, any combination of light between thirty (30) percent and seventy (70) percent of each source 218, 220 may be used provided the combination equals substantially one-hundred (100) percent. In the foregoing configuration shown in FIG. 12A, the beam splitter 202 may be positioned proximate to the sight glass 148 such that light from the beam splitter 202 is received by the optical element 18.

Figure 13:
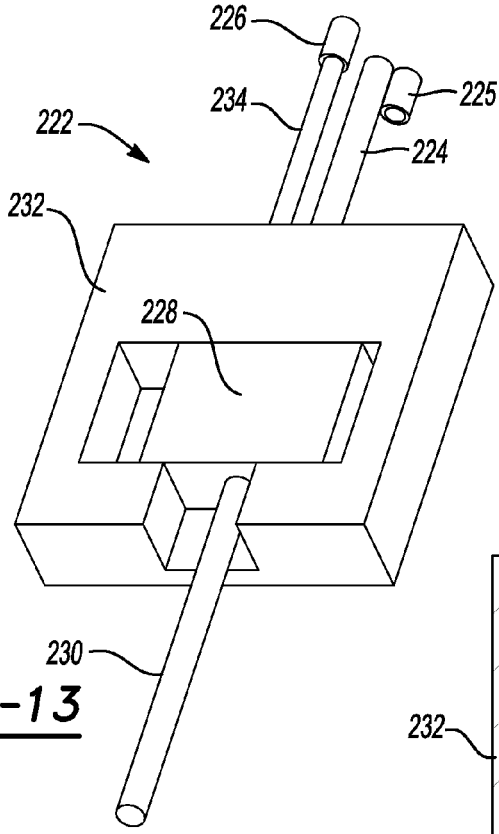
FIG. 13 is a perspective view of a switch for use with an optical sight in accordance with the principles of the present disclosure.
Figure 14:
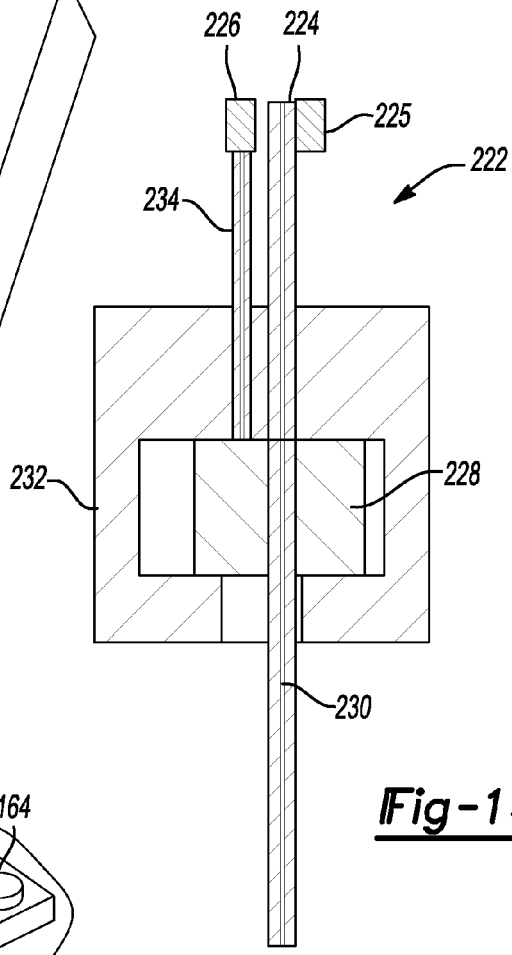
FIG. 14 is a cross sectional view of the switch of FIG. 12.

With particular reference to FIGS. 13 and 14, a switch 222 is provided and may receive an input from more than one source (i.e., from an LED 226 and a fiber 224). The switch 222 may include a movable body 228 having an output fiber 230 fixed for movement therewith, whereby light from the LED 226 and light from the fiber 224 may be selectively supplied to the output fiber 230. Specifically, the output fiber 230 may be moved through movement of the body 228 between connection with the fiber 224 and a fiber 234 attached to the LED 226. Therefore, by moving the body 228 relative to a housing 232 supporting the body 228, the output fiber 230 may be selectively supplied with light either from the LED 226 via conduit 234 or with light from the fiber 224 and can therefore supply the output fiber 230 with light from one of two sources independent from one another. An end of the output fiber 230 may be received generally within a substrate such as the substrate 138*a* of FIG. 10. As such, the output from output fiber 230 may be directed to the optical element 18 to supply the optical element 18 with the reticle 22.

While the switch 222 is shown as including a slidable body 228, the switch 222 could alternatively include a rotatable member (not shown) that allows a user to select between a mode, whereby the LED 226 is exclusively used or a mode whereby the fiber 224 is exclusively used.

In either of the foregoing configurations, a tritium lamp 225 may be used in conjunction with the fiber 224 and/or LED 226 to enhance the ability of the fiber 224 and/or LED 226 to supply light to the output fiber 230. The tritium lamp 225 could alternatively supply light to the output fiber 230 independent of the fiber 224 and/or LED 226 such that the switch 222 supplies light to the output fiber 230 from any one of the fiber 224, the LED 226, or the tritium lamp 225 individually by selectively moving the slidable body 228 relative to the respective sources 224, 226, 225. While the tritium lamp 225 may be used in combination with the fiber 224 and/or LED 226, any of the sources 224, 226, 225 could be combined by the switch 222 to provide light from multiple sources simultaneously.

What is claimed is:

1. An optical sight comprising:

a housing including a base, a first post extending from said base, and a second post extending from said base;

an optical element supported by said housing between said first post and said second post;

a reticle displayed on said optical element;

an illumination system directing light away from said base and toward said optical element such that said light travels through an area external from said housing prior to reflecting off of said optical element, said optical element reflecting at least a portion of said light received from said illumination system to generate said reticle; and a first actuation member disposed on one of said first post and said second post and operable to selectively control an intensity of said reticle by controlling an output of said illumination system.

2. The optical sight of claim 1, wherein said illumination system is operable between a manual mode and an automatic mode.

3. The optical sight of claim 2, wherein said first actuation member is operable to toggle said illumination system between said manual mode and said automatic mode.

4. The optical sight of claim 2, wherein said first actuation member is selectively movable between a first state and a second state, said first actuation member operable to control said intensity of said reticle when said illumination system is in said manual mode and said first actuation member is in said second state.

5. The optical sight of claim 1, further comprising a second actuation member operable to selectively control said intensity of said reticle by controlling said output of said illumination system.

6. The optical sight of claim 5, wherein said second actuation member is disposed on the other of said first post and said second post.

7. The optical sight of claim 6, wherein said first post includes a first surface opposing said optical element and said second post includes a second surface opposing said optical element, said first actuation member being disposed on an opposite side of said first post than said first surface and said second actuation member being disposed on an opposite side of said second post than said second surface.

8. The optical sight of claim 1, wherein said illumination system includes at least one of an LED and a photo sensor.

9. The optical sight of claim 8, wherein said illumination system is operable in a manual mode and an automatic mode, said first actuation member is operable to control said intensity of said reticle by controlling an output of said LED when said illumination system is in said manual mode.

10. The optical sight of claim 9, wherein said illumination system includes said LED and said photo sensor, said photo sensor controlling said intensity of said reticle by controlling said output of said LED when said illumination system is in said automatic mode.

11. The optical sight of claim 10, wherein said first actuation member is operable to toggle said illumination system between said manual mode and said automatic mode.

12. An optical sight comprising:

a housing including a base, a first post extending from said base, and a second post extending from said base;

an optical element supported by said housing between said first post and said second post;

a reticle displayed on said optical element;

an illumination system generating said reticle;

a first actuation member disposed on one of said first post and said second post and movable between a first state and a second state; and a second actuation member disposed on the other of said first post and said second post and movable between a first state and a second state, said first actuation member and said second actuation member operable to selectively control an intensity of said reticle by controlling an output of said illumination system.

13. The optical sight of claim 12, wherein said illumination system is operable between a manual mode and an automatic mode.

14. The optical sight of claim 13, wherein said first actuation member and said second actuation member are operable to toggle said illumination system between said manual mode and said automatic mode.

15. The optical sight of claim 13, wherein said first actuation member and said second actuation member are selectively and independently movable between said first states and said second states, at least one of said first actuation member and said second actuation member operable to control said intensity of said reticle when said illumination system is in said manual mode and one or both of said first actuation member and said second actuation member are in said second state.

16. The optical sight of claim 12, wherein said first post includes a first surface opposing said optical element and said second post includes a second surface opposing said optical element, said first actuation member being disposed on an opposite side of said first post than said first surface and said second actuation member being disposed on an opposite side of said second post than said second surface.

17. The optical sight of claim 12, wherein said illumination system includes at least one of an LED and a photo sensor.

18. The optical sight of claim 17, wherein said illumination system is operable in a manual mode and an automatic mode, at least one of said first actuation member and said second actuation member is operable to control said intensity of said reticle by controlling an output of said LED when said illumination system is in said manual mode.

19. The optical sight of claim 18, wherein said illumination system includes said LED and said photo sensor, said photo sensor controlling said intensity of said reticle by controlling said output of said LED when said illumination system is in said automatic mode.

20. The optical sight of claim 19, wherein at least one of said first actuation member and said second actuation member are operable to toggle said illumination system between said manual mode and said automatic mode.

* * * * *